US005338220A

United States Patent [19]

Soes et al.

[11] Patent Number: 5,338,220

[45] Date of Patent: Aug. 16, 1994

[54] ELECTRICAL CONNECTOR HOUSING ASSEMBLY AND AN ELECTRICAL TERMINAL THEREFOR

[75] Inventors: Lucas Soes, Rosmalen; Franciscus G. Vugts, Vught, both of Netherlands

[73] Assignee: The Whitaker Corporation, Wilmington, Del.

[21] Appl. No.: 60,941

[22] Filed: May 11, 1993

[30] Foreign Application Priority Data

May 19, 1992 [GB] United Kingdom ..... 9210619
Jun. 15, 1992 [GB] United Kingdom ..... 9212653
Jul. 20, 1992 [GB] United Kingdom ..... 9215364

[51] Int. Cl.[5] ..... H01R 4/24
[52] U.S. Cl. ..... 439/403; 439/417
[58] Field of Search ..... 439/403, 404, 417, 492, 439/498, 499, 67

[56] References Cited

U.S. PATENT DOCUMENTS 5,009,612 4/1991 Rishworth et al. ..... 439/403
5,049,088 9/1991 Rishworth et al. ..... 439/417
5,119,899 6/1992 Johnson et al. ..... 180/177

FOREIGN PATENT DOCUMENTS 150593 8/1985 European Pat. Off. .
382482 8/1990 European Pat. Off. .
478400 4/1992 European Pat. Off. .
2739210 8/1977 Fed. Rep. of Germany .
3722187 1/1989 Fed. Rep. of Germany .
2470458 5/1981 France .
1543661 4/1979 United Kingdom .

*Primary Examiner*—Gary F. Paumen
*Attorney, Agent, or Firm*—Eric J. Groen

[57] ABSTRACT

An electrical connector housing assembly consists of an insulating housing and a pair of insulating covers. The housing has a row of cavities extending diagonally across a central wall of the housing, each for receiving an electrical terminal having slotted plate portions with wire receiving slots opening in opposite directions and being located on opposite surfaces of the central wall. Each cover has a row of notches extending across a base wall of the cover, for receiving the end portion of a respective one of the slotted plates. According to a first mode of use, the slotted plates of each terminal are coplanar with each other and the covers are mated with the housing to drive the wires of flat flexible cables, into the wire receiving slots of the terminals with the two cables extending parallel to each other. According to a second mode of use, the slotted plates of each terminal, are twisted about a neck of the terminal so that the slotted plates thereof extend at right angles to each other. For this mode of use, one of the covers is mated with the housing in a second angular orientation which is orthogonal with respect to the first angular orientation, the cables extending at right angles to each other, according to the second mode.

13 Claims, 20 Drawing Sheets

ELECTRICAL CONNECTOR HOUSING ASSEMBLY AND AN ELECTRICAL TERMINAL THEREFOR

BACKGROUND OF THE INVENTION

1. Field of the Invention

This invention relates to an electrical connector housing assembly and electrical terminal therefor. The invention relates, in particular, to a housing assembly for an electrical connector for connecting corresponding wires of groups of wires, especially the wires of two flat flexible electrical cables.

2. Description of the Prior Art

Such a housing assembly is disclosed in U.S. Pat. No. 5,049,088, according to which, an electrical connector housing assembly comprises an insulating housing and first and second insulating covers for mating with the housing, the housing having a plurality of through cavities each for accommodating an electrical terminal with wire receiving portions thereof projecting from opposite surfaces of the housing, each cover having a corresponding plurality of notches each for receiving the wire receiving portion of a respective terminal and being bounded by wire stuffer surfaces for stuffing wires into said wire receiving portion, each cover being matable with the housing to stuff wires into the wire receiving portions on a respective one of said opposite surfaces of the housing when the terminals are accommodated in said cavities.

This known housing assembly, with the terminals accommodated in said cavities, so as to provide a complete electrical connector, is capable of interconnecting two groups of wires extending only in orthogonal directions. There is a requirement, however, in particular in the automotive industry, for a connector housing assembly, which can be loaded with electrical terminal either for connecting two groups of wires so that the wires of the groups extend orthogonally or so that the wires of the groups extend parallel to one another. It will be readily appreciated, that in a crowded environment, the groups of wires should extend from the connector in the direction in which they are to be connected to other connectors or to electrical components, as the case may be.

SUMMARY OF THE INVENTION

According to the present invention, an electrical connector housing assembly as defined in the second paragraph of this specification, is characterized in that at leased one of the covers is matable with the housing in a first angular orientation with respect thereto to stuff wires extending in a first direction, into said wire receiving portions on said respective surface of the housing and in a second orientation with respect to the housing to stuff wires extending in a second direction into said wire receiving portions on said respective surface of the housing, the notches of said at lease one cover being so distributed thereon as to be aligned with respective ones of said cavities in each of said angular orientations of said at least one cover.

In order to connect two groups of wires so that they extend parallel to one another, electrical terminals, the wire receiving portions, usually slotted plates, of each of which are arranged in coplanar relationship are inserted into the terminal receiving cavities. If however the groups of wires are to extend in orthogonal directions, electrical terminals, the slotted plates of each of which are disposed in orthogonal planes, are inserted into the wire receiving cavities, as described in detail below. Although only one of the covers need be capable of being mated with the housing in said first and second orientations, it is preferable that both covers should be capable of this, so that where the slotted plates of each terminal are not coplanar, the terminal receiving cavities can be loaded with terminals by way of either of said opposite surfaces of the housing. Conveniently, the slotted plates of each terminal are connected by a narrow neck of the terminal material, so that the slotted plates can be twisted out of coplanar relationship. In order to ensure that the notches of said at least one cover are aligned with respective terminal receiving cavities, the notches, and the cavities, are preferably arranged in rows, extending diagonally across said at least one cover and the housing respectively.

The housing may be of square cross section, having first and second opposite side walls, each cover having a pair of opposite side walls for mating engagement alternatively with either of the first side walls or the second side walls of the housing. The said opposite surfaces of the housing may be provided on a central wall thereof connecting the two pairs of side walls, guide members for the slotted plates of the terminals being provided on each of said opposite surfaces and defining the slots for receiving the slotted plates into orthogonal planes.

A further object of the invention is to provide an electrical terminal which is usable in two different directions, one where the wires are parallel and where the wires are situated orthogonally from each other. There is disclosed in FR-A-2470458, a one piece, sheet metal electrical terminal having a lead receiving portion and a mating portion, the lead receiving portion comprising a main plate from which projects a pair of arms defining a lead receiving blind slot opening away from the main plate to receive an electrical lead inserted into the slot in a first direction, electrically to connect the lead to the terminal, the mating portion being connected to the lead receiving portion to receive a mating portion of a mating electrical terminal in a second direction opposite to the first direction.

According to an aspect of the invention, a one piece electrical terminal for the housing assembly, comprises interconnected first and second slotted plates each having a wire receiving slot, the slots opening in opposite directions, and is characterized in that the slotted plates are arranged in coplanar relationship, the first slotted plate having a pair of aligned shoulders facing the second slotted plate, an elongate neck extending from the first slotted plate, between the shoulders thereof, in coplanar relationship with the slotted plates, the neck being connected to an edge of the second slotted plate facing said shoulders, a rectilinear terminal retention tongue coplanar with the neck extending from said edge on either side of the neck and towards a respective one of the shoulders. The first and second slotted plates can, be twisted about the neck into orthogonal relationship. The retention tongues serve to anchor the terminal with a pressed fit, into a respective one of the terminal cavities, each of two opposite edges of the cavity urging the tongues resiliently towards one another in their own plane. Since the retention tongues are deformed in their own planes, they are stiffly resilient, so as to ensure that the terminal is received in its cavity with a forced fit.

According to the present invention, a one-piece sheet metal electrical terminal, is characterized in that the main plate of the lead receiving portion is connected to the mating portion by way of an elongate neck which is plastically deformable torsionally, relatively angularly to displace the lead receiving portion and the mating portion about a longitudinal axis of the terminal extending through the neck; and in that the mating portion is matable with the mating portion of a similar electrical terminal.

The lead receiving portion and the mating portion of the terminal can therefore be twisted relative to one another about the neck, so that when the mating portion is mated with the mating portion of the similar electrical terminal, leads inserted into the slots of the lead receiving portions of the terminals, extend in desired, relatively angled directions, for example, in mutually orthogonal directions.

In some applications, it may be necessary to have a two piece housing, where the connector halves are disconnectable from each other. In this case the mating portions of the terminals may comprise a receptacle and a tab, the receptacle being located to receive the tab of a similar electrical terminal and the tab being located for reception in the receptacle of the similar electrical terminal.

The receptacle and the tab may comprise a common flat elongate plate, the receptacle having a pair of spring ears projecting from opposite longitudinal edges of the elongate plate and having free contact edges proximate to, but spaced from a first major surface of the elongate plate for engaging the tab of the similar electrical terminal. The elongate plate projects beyond the ears in a direction away from the lead receiving portion to provide the tab. Thus, when the two hermaphroditic terminals are mated, the receptacle portions lie in back to back relationship with one another with the contact edges of the ears of one mating portion engaging the tab of the other mating portion whereby the terminals are firmly secured in mating relationship. These terminals may also comprise a neck portion located intermediate the insulation displacement portion and the hermaphroditic contact portion which can be twisted to reposition the contacts in alternate directions.

According to another aspect of the invention, a pair of hermaphroditic, one-piece electrical terminals are characterized in that the contact plate of each terminal is formed with a longitudinally extending blind slot opening into an edge of the contact plate, for receiving the contact plate of the other terminal, whereby the terminals are matable according to a second mode with the contact plates thereof extending orthogonally with respect to each other, the contact spring of each terminal having a spring beam part extending alongside a major surface of the contact plate of the terminal for engaging against the contact plate of the other terminal in both of said mating modes.

Although, where the terminals fixedly secured in respective mating housings, each terminal may be provided with only one contact spring, it is preferable that at least for redundancy and improved electrical contact purposes, each terminal should have two contact springs for engaging the contact plate of the mating terminal in both of said mating modes.

Advantageously, the contact spring of each terminal comprises a part which acts as a back up spring in both of said modes. This back up spring part, preferably extends from an edge of the contact plate of the terminal and is curled over said major surface of the contact plate, the spring beam part of the contact spring extending from an end of the back up spring part. For accommodating the two mating modes, the spring beam part of the, or each, contact spring of each terminal comprises a pair of contact surfaces projecting from the spring beam part in orthogonal directions, each for engaging the contact plate of the other terminal in a respective one of said modes.

According to another aspect of the invention a one-piece, hermaphroditic electrical terminal comprises an elongate contact plate having a longitudinal axis, a forward end portion having a forward edge, first and second opposite major surfaces and opposite longitudinal edges. The contact plate has a rearwardly extending blind slot bisecting the longitudinal axis and opening into the forward edge of the contact plate, the slot being of slightly greater width than the thickness of the contact plate. A pair of opposed contact springs, each has an arcuate spring part extending from a respective one of the longitudinal edges of the contact plate and a spring beam part. The arcuate part of each contact spring is curled over from the respective longitudinal edge of the contact plate, towards the first major surface thereof and the spring beam part extends rearwardly alongside said major surface from an end of the arcuate part proximate to the major surface. Each spring beam part has a pair of first contact surfaces disposed on opposite sides of the longitudinal axis of the contact plate and projecting towards the first major surface, and a pair of second contact surfaces projecting towards each other from two opposite sides of the longitudinal axis. The contact surfaces of the second pair are spaced from each other by less than the thickness of the contact plate. This ensures that in the second mating mode the contact plate of the mating terminal is securely gripped between the contact surfaces of the second pair.

BRIEF DESCRIPTION OF THE DRAWINGS

FIG. 3 is a fragmentary enlarged view illustrating details of FIG 2;

FIG. 18 is an isometric view of an hermaphroditic electrical terminal;

DETAILED DESCRIPTION OF THE PREFERRED EMBODIMENT

Figure 7:
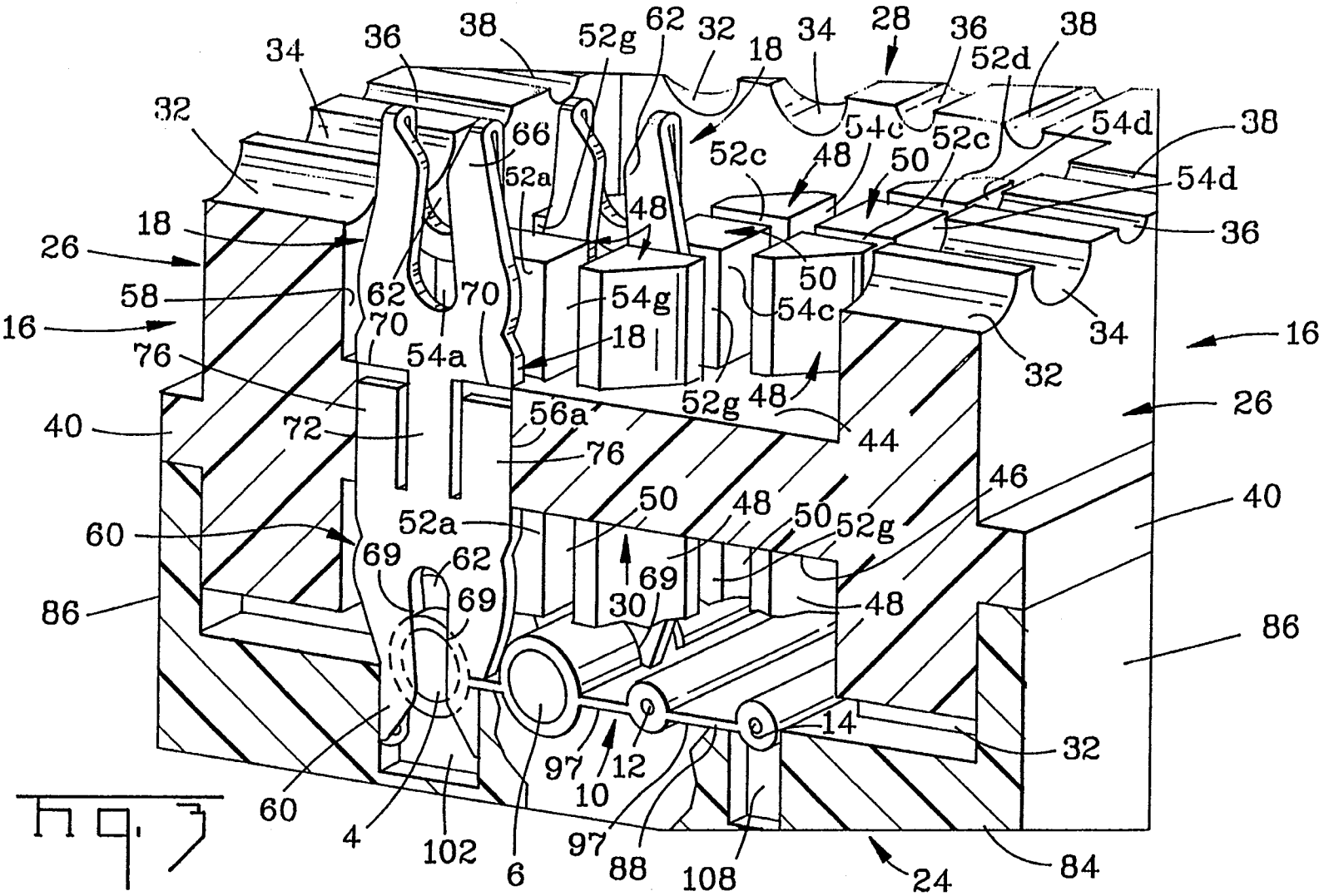
FIG. 7 is a partially exploded isometric view showing the connector when arranged for interconnecting the wires of the cables according to a second mode.
Figure 4:
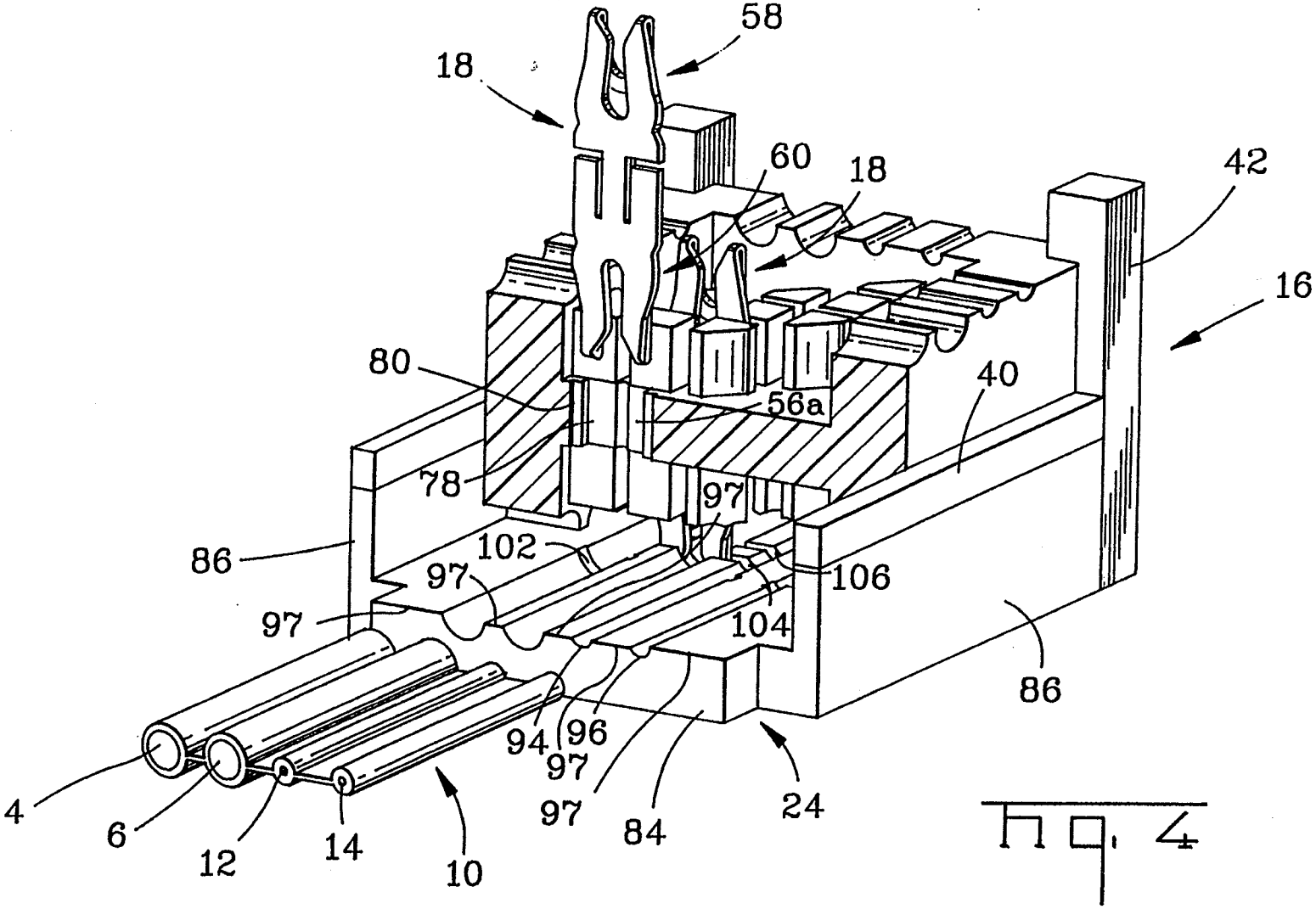
FIG. 4 is a partially exploded isometric view shown partly in section, of the connector, showing one of the covers and one of the cables.
Figure 6:
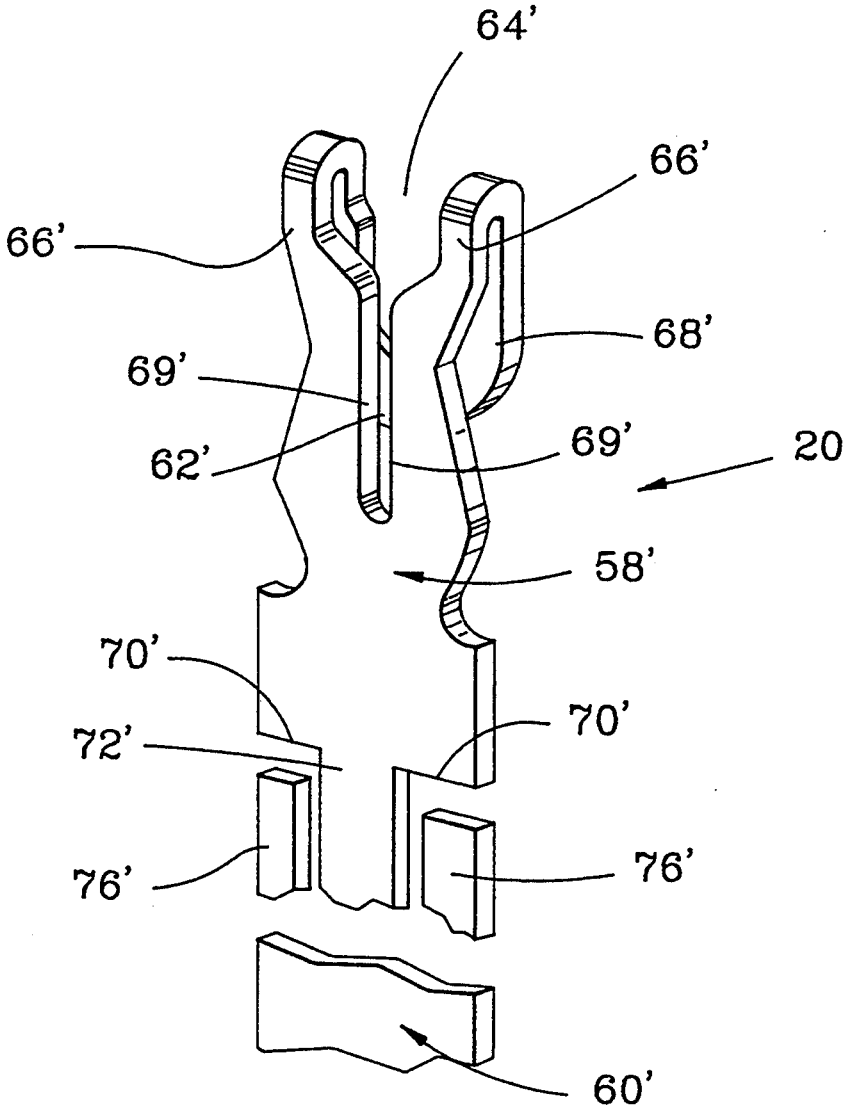
FIG. 6 is an enlarged, fragmentary, isometric view of a signal wire terminal of the connector.
Figure 7:
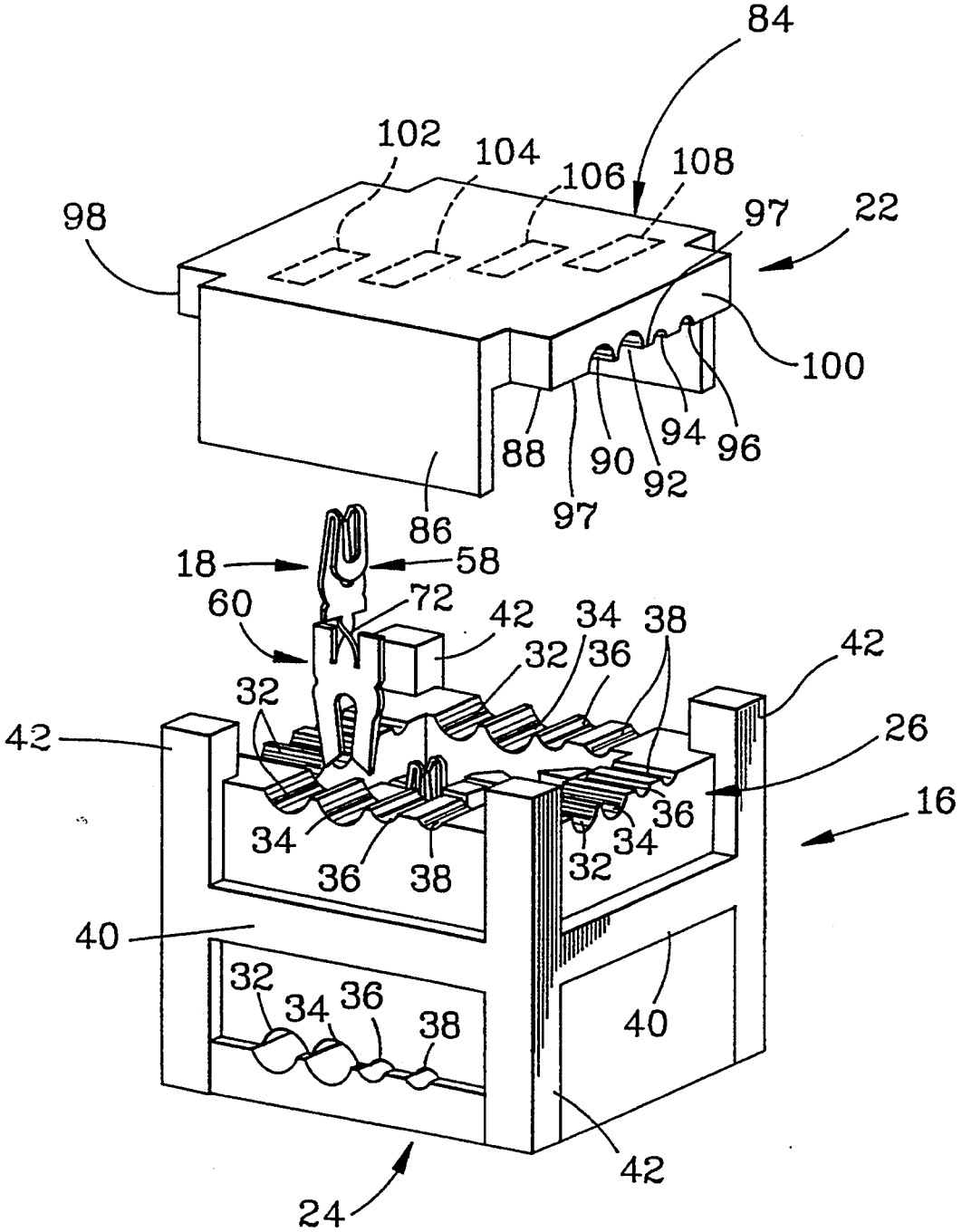
Figure 8:
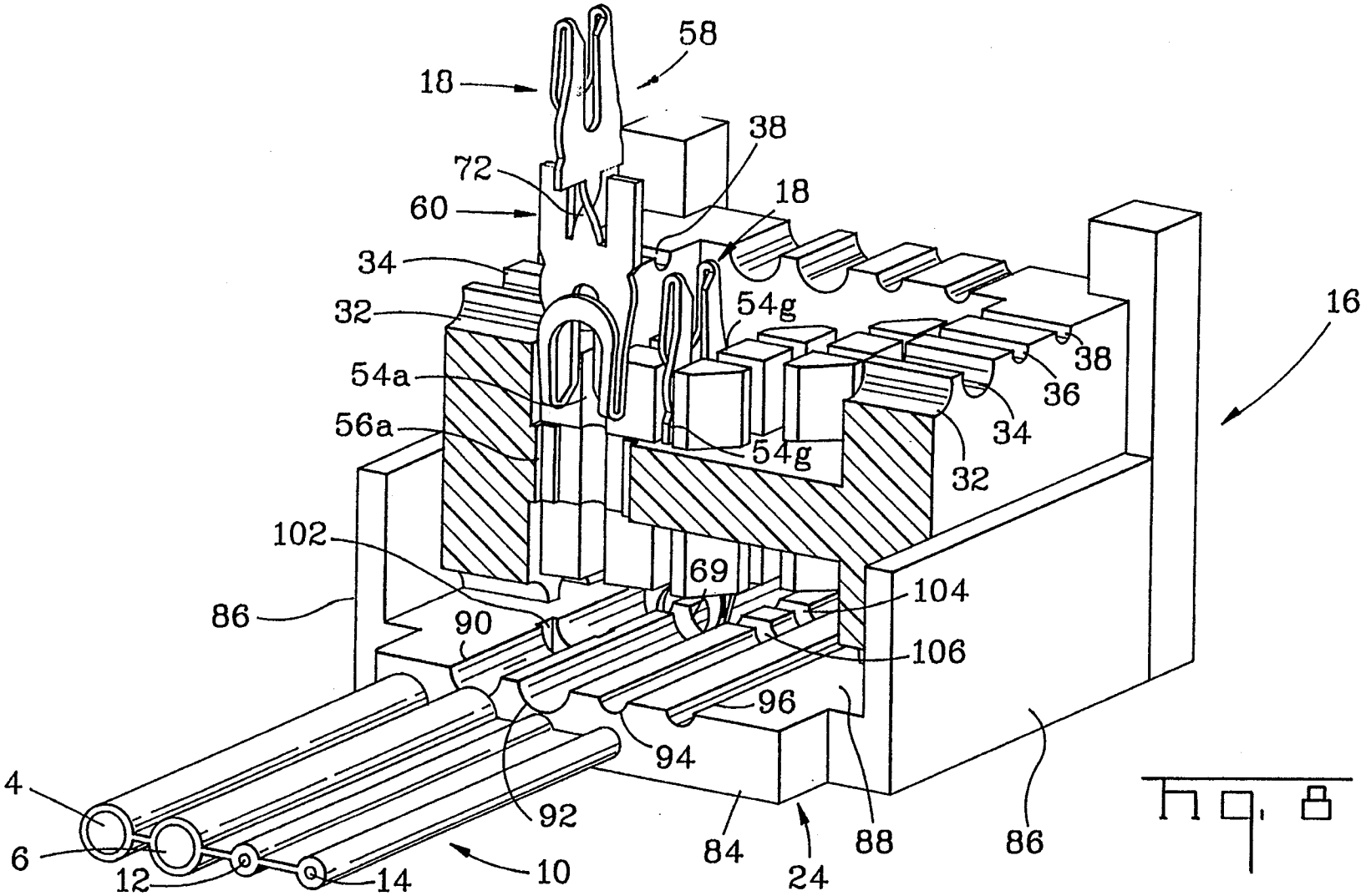
FIG. 8 is a similar view to that of FIG. 4 but showing the connector arranged for connecting wires according to the second mode.
Figure 9:
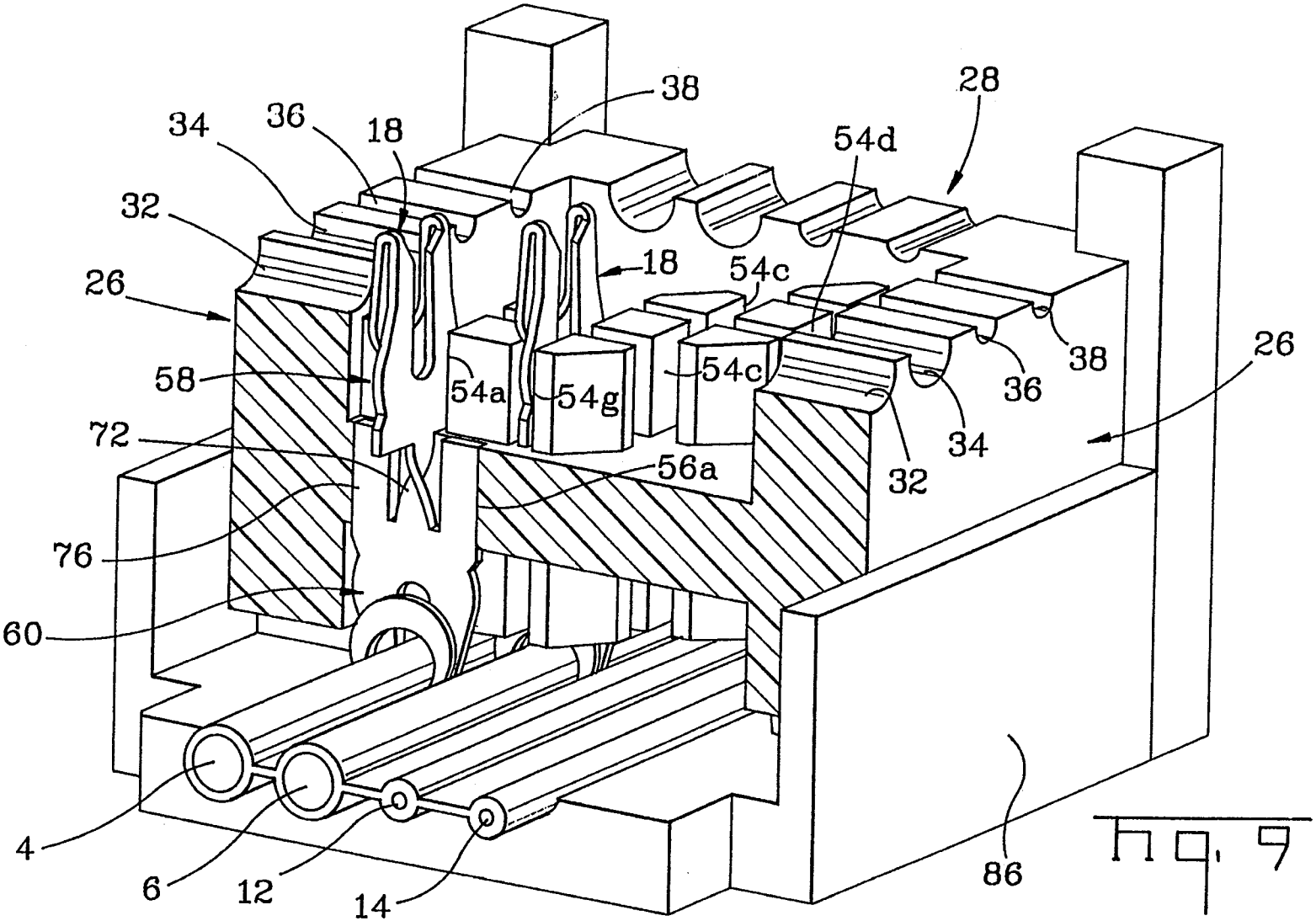
FIG. 9 is a enlarged isometric view shown partly in section showing the housing, two of the terminals, one of the covers, and one of the cables, the terminals having been prepared for connecting the cable wires according to the second mode.

An electrical connector 2 is adapted for connecting power wires 4 and 6 and signal wires 12 and 14 of a first flat, flexible electrical cable 8 to respective power wires 4 and 6 and signal wires 12 and 14 of a second, flat, flexible electrical cable 10, according to a first mode (FIGS. 1 to 4) and according to a second mode (FIGS. 7 to 9). The connector comprises an overall square shaped insulating housing 16, two power wire connecting electrical terminals 18, two signal wire connecting electrical terminals 20 (FIG. 6), only one of which is shown, and upper and lower wire stuffing covers 22 and 24, respectively, for the housing 16, said covers and said housing constituting a housing assembly.

Figure 2:
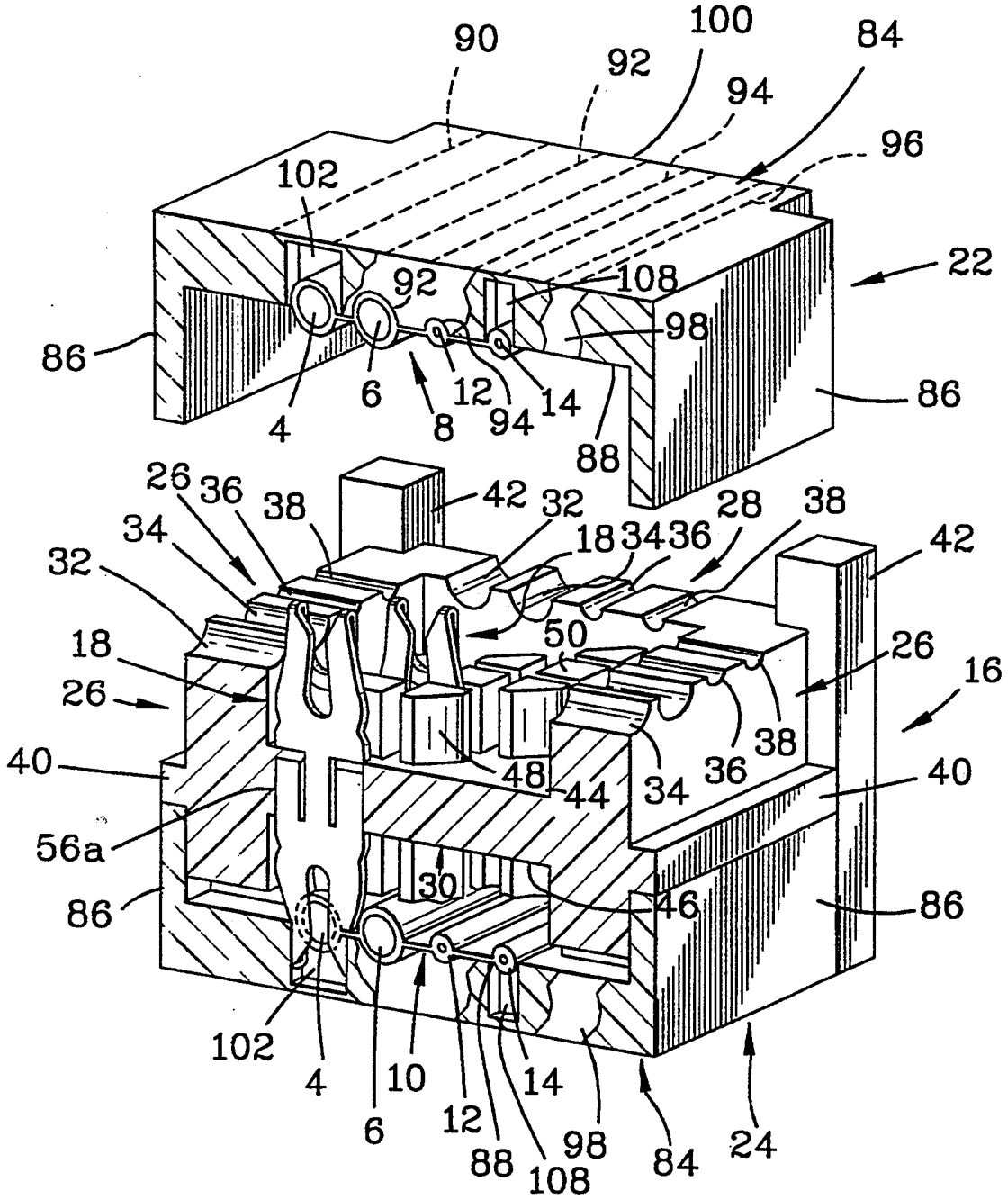
FIG. 2 is a partially exploded isometric view, shown partly in section, of the connector of FIG. 1 and also showing the cables.

As shown best in FIG. 2, the housing 16 comprises a first pair of opposed side walls 26, a second pair of opposed side walls 28, and a horizontal central wall 30 interconnecting the side walls 26 and 28 and being arranged centrally of their height. Each side wall 26 and 28 has top and bottom free edges each formed with four semi-circular cross-section, cable wire receiving grooves, namely two power wire receiving larger cross-section grooves 32 and 34, respectively, and two signal wire receiving, smaller cross-section, grooves 36 and 38, respectively. The grooves 32,34,36 and 38 of one side wall 26 are aligned with the grooves 32, 34, 36 and 38, respectively, the other side wall 26. Similarly, the grooves 32, 34, 36 and 38 of one side wall 28 are aligned with the grooves 32, 34, 36 and 38, respectively, of the other side wall 28. Each side wall 26 and 28 has a centrally disposed cover stop rib 40.

Figure 10:
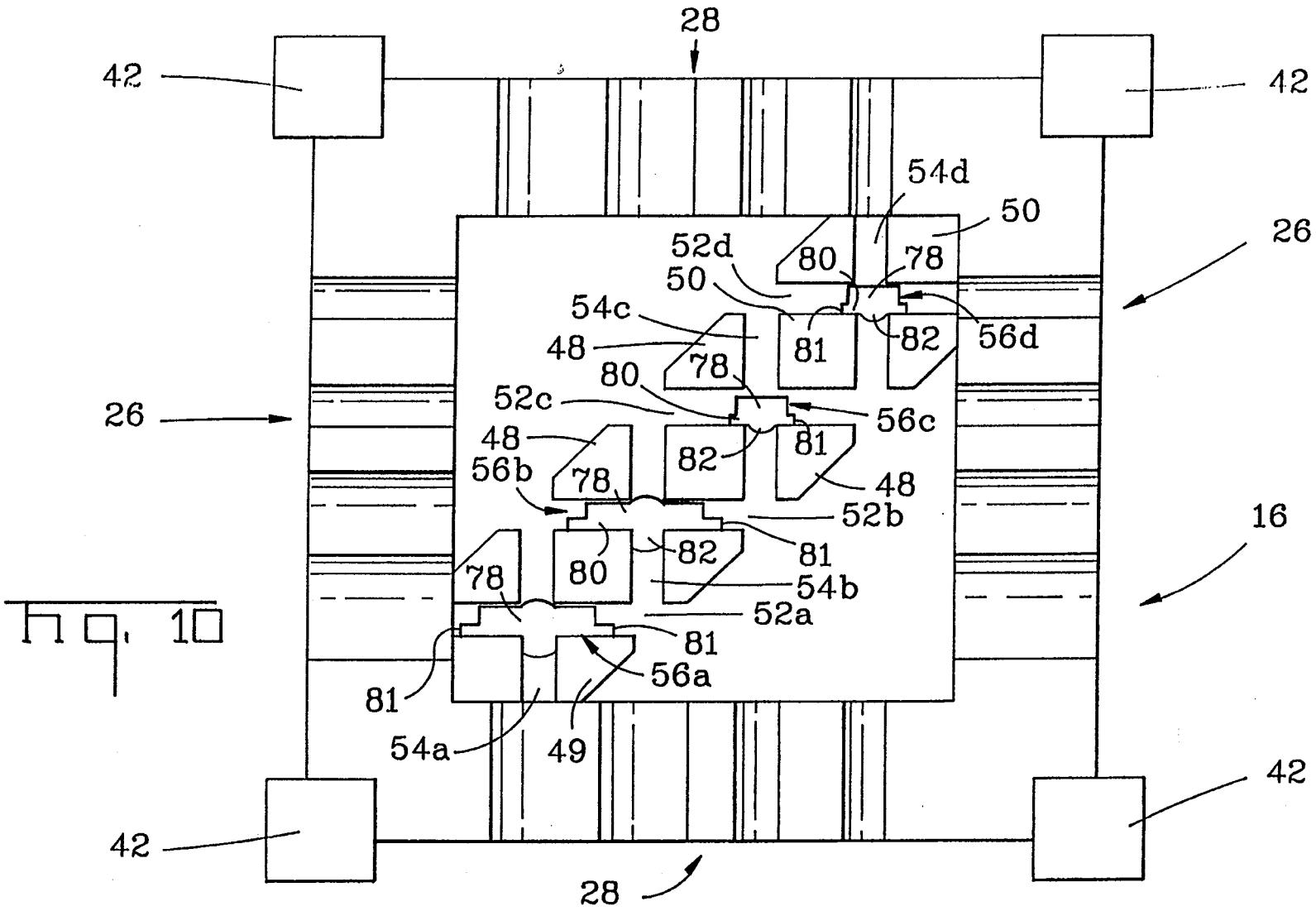
FIG. 10 is an enlarged plan view of the housing.

The housing 16 has recessed into each corner thereof, a vertical cover guide post 42. The central wall 30 has a top face 44 and a bottom face 46. There project from each of the faces 44 and 46, as best seen in FIG. 10, thirteen cable support and terminal guide posts 48 and 50. Each post 48 on one of the faces 44 and 46 is disposed exactly opposite to and in axial and angular alignment with, a respective post 48 in the other face of the wall 30 and each post 50 and one face of the wall 30 is a disposed opposite to, and in axial and angular alignment with a post 50 on the other face of the wall 30. The posts 48, which are identical are of substantially triangular cross-section, the posts 50 which are also identical, being of square cross-section. As shown in FIG. 10 the posts 48 and 50 are arranged in groups extending in a row diagonally across the central wall 30, which is square, the posts of each group cooperating to define a pair of aligned terminal guide slots 52 and a pair or aligned terminal guide slots 54, the slots 52 and 54 extending at right angles to each other. Each group of posts comprises the two posts 48 and two posts 50, a post 50 being common to each group. The slots 52 extend normally of the side walls 26 and the slots 54 extend normally of the side walls 28.

The central wall 30 is formed with a row of four, through terminal receiving cavities 56*a* and 56*b* and 56*c* and 56*d* each disposed at the junction between the slots 52 and 54 of the respective group of the posts 48 and 50 on both of the faces 44 and 46 of the central wall 30. The cavities 56 are spaced from each other diagonally across the wall 30. The cavities 56*a*, 56*b*, 56*c* and 56*d* are thus offset from one another both in a direction at right angles to the side walls 26 and in a direction at right angles to the side walls 28 as determined by said diagonal arrangement of the groups of posts 48 and 50.

The cavities 56*a* and 56*b* are for receiving respective power wire terminals 18, the cavities 56*c* and 56*d* being for receiving respective signal wire terminals 20. The cavity 56*a* communicates with a first pair referenced 52*a* of the aligned slots 52 on each side of the wall 30. The cavity 56*b* communicates with a second pair, referenced 52*b* of the aligned slots 52 on each side of the wall 30. The cavity 56*c* communicates with a third pair, referenced 52*c* of the aligned slots 52 on each side of the wall 30. The cavity 56*d* communicates with a fourth pair, referenced 52*d* of the aligned slots 52 on each side of the wall 30. Each pair of aligned slots 52*a* and the cavity 56*a* are aligned with a groove 32 of each side wall 26, each pair of aligned slots 52*b* and the cavity 56*b* are aligned with a groove 34 of each side wall 26, each pair of aligned slots 52*c* and the cavity 56*c* are aligned with a groove 36 of each side wall 26 and each pair of aligned slots 52*d* and the cavity 56*d* are aligned with a groove 38 of each side wall 26. Similarly, each pair of aligned slots 54*a* is aligned with a groove 32 each side wall 28, each pair of aligned slots 54*b* is aligned with a groove 34 of each side wall 28, each pair of aligned slots 54*c* is aligned with a groove 36 of each side wall 28 and each pair of aligned slots 54*d* is aligned with a groove 38 of each side wall 28. As will be apparent from the foregoing, the wall 30 with its posts 48 and 50 is symmetrical about its central horizontal plane.

Figure 5:
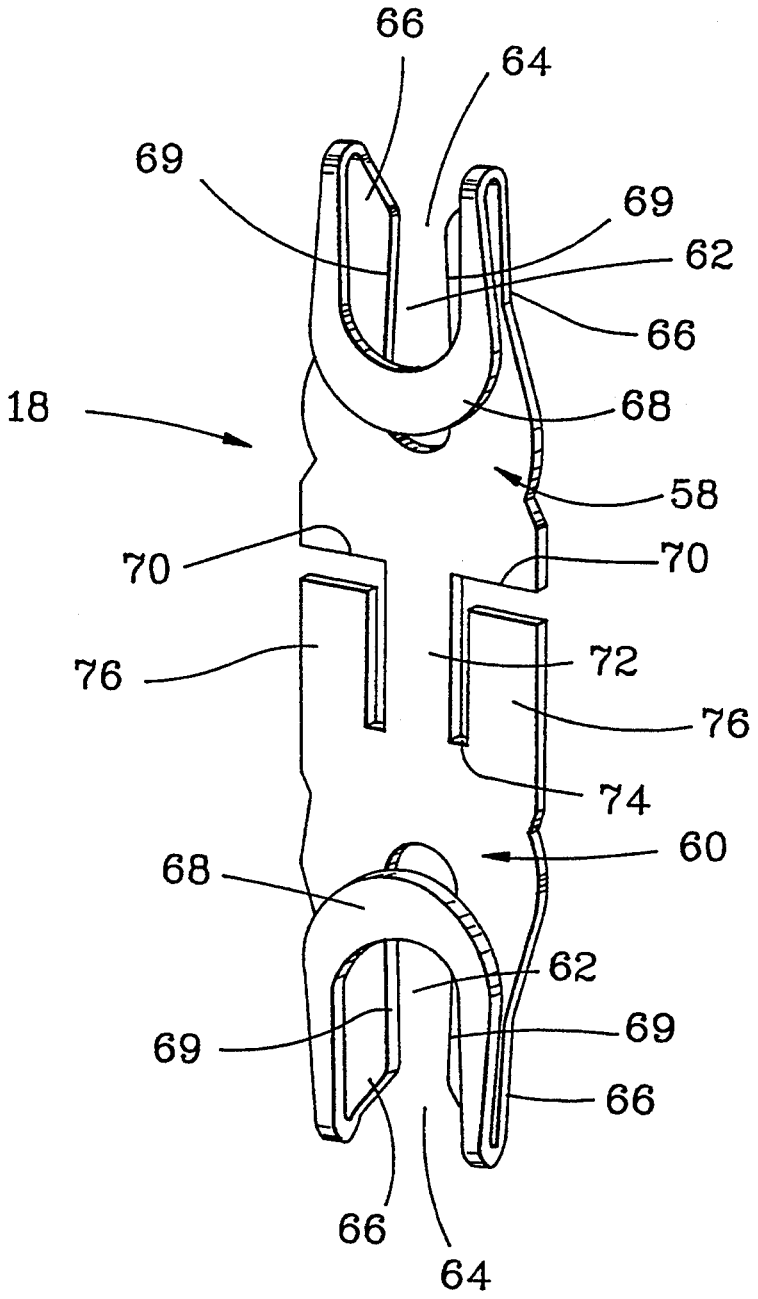
FIG. 5 is an enlarged isometric view of a power wire electrical terminal of the connector.

As shown in FIG. 5, each power wire terminal 18 which has been stamped and formed from a single piece of sheet metal stock, comprises an upper slotted plate 58 and a lower slotted plate 60 in coplanar relationship therewith. Each slotted plate 58 and 60 has a wire receiving slot 62 dimensioned to receive a respective power wire, the slots 58 and 60 having wire receiving mouths 64 opening in opposite directions. Each slot 62 is defined by a pair of arms 66 having free ends spanned by a resilient yoke 68 which acts as a backing spring to secure the edges 69 of the slot 62 about the core of the power wire inserted thereinto. The plate 68 has opposed bottom shoulders 70 between which extends an elongate, rectilinear neck 72 connected to an upper edge 74 of the plate 60. There projects from the edge 74 on each side of the neck 72, towards a respective shoulder 70, a rectilinear, elongate planar with retention tongue 76 which is coplanar with the slotted plates 58 and 60.

Each signal wire terminal 20, which is constructed analogously with the terminals 18 and corresponding parts of which, therefore, bear the same reference and numerals as those in FIG. 5, but with the addition of a prime symbol, comprises an upper slotted plate 58' and a lower slotted plate 60', having terminal retention tongues 76'. The terminals 20 differ essentially from the terminals 18, in that they are narrower in their own planes than the terminals 18 and in that the wire receiving slots 62' of the terminals 20 are narrower than the wire receiving slots 62 of the terminals 18. This is because the signal wires are of very much smaller gauge than the power wires. The cavities **56*c* and 56*d* for the terminals 20 are substantially smaller than the cavities 56*a* and 56*b* for the terminals 18. Each of the cavities 56 which extend lengthwise of a respective pair of the aligned slots 52 has a first shorter and thicker portion 78 through which the slotted plate 60, or 60' as the case may be, of the respective terminal can be passed, a longer but narrower portion 80 for receiving the neck and the retention tongues of the terminal and a domed portion 82**.

Figure 1:
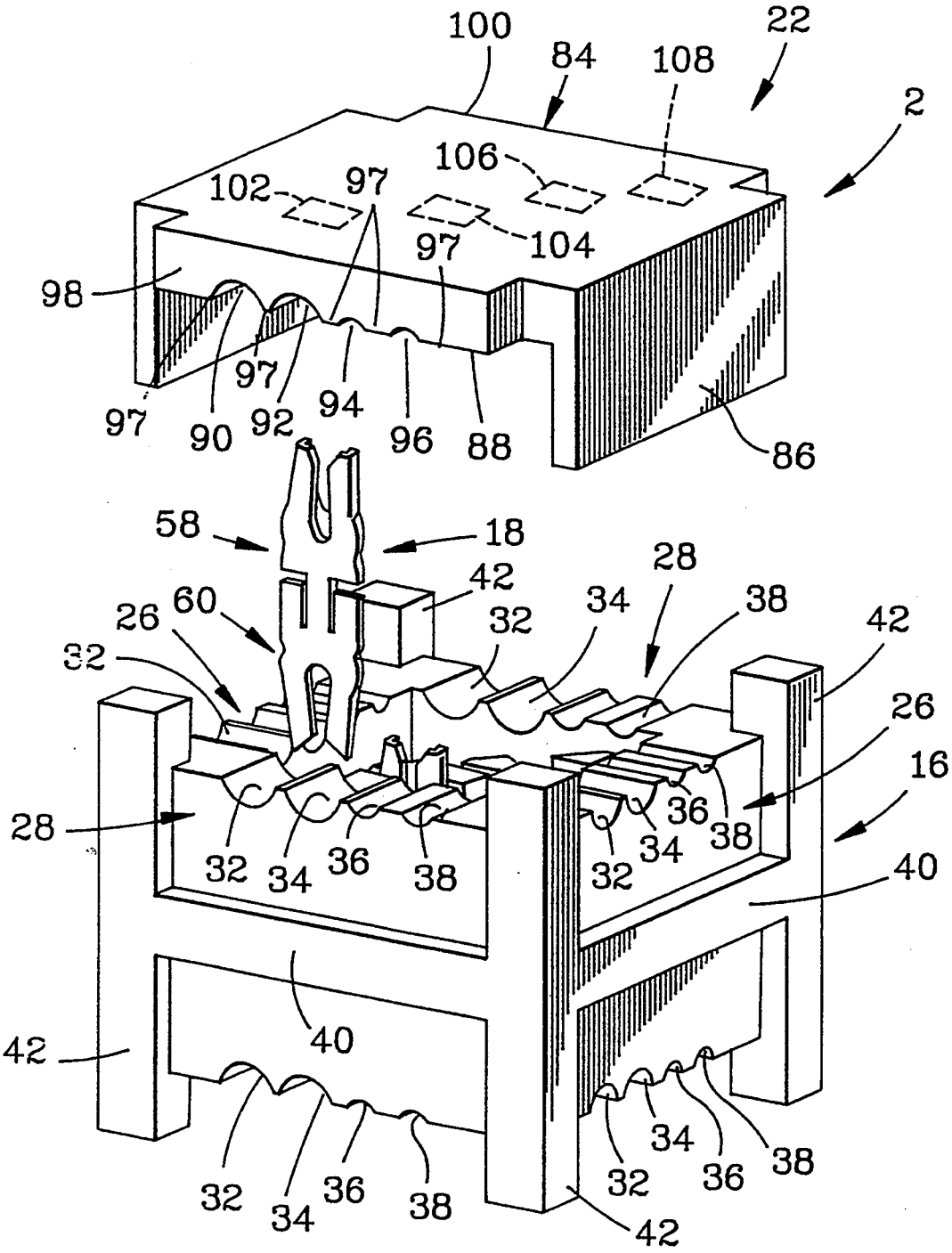
FIG. 1 is a partially exploded isometric view of an electrical connector arranged for interconnecting wires of a pair of flat flexible cables according to a first mode, the connector comprising an insulating housing, a pair of insulating covers therefor (only one of which is shown) and four insulation displacement electrical terminals (only two of which are shown)

Each of the cover 22 and 24 comprises, as best seen in FIGS. 1, 2 and 7, a square base 84 from each of two opposite edges of which depends a rectangular, cover-retention, side wall 86 of substantially smaller thickness than the base 84. The inner face 88 each cover 22 and 24 is formed with a row of parallel, semi-circular cross-section, wire receiving grooves 90, 92, 94 and 96, respectively, extending parallel to the side walls 86, for receiving the wires 4, 6, 12 and 14, respectively, of a respective one of the cables 8 and 10. There is provided on each side of each of these grooves, a wire stuffer surface 97 of the base 84. The grooves 90 and 92 are of the same cross-sectional area as the grooves 32 and 34 of the housing, the grooves 94 and 96 being of the same cross-sectional area as the grooves 36 and 38 of the housing 16. Each of the grooves 90, 92, 94 and 96 opens into two opposite edges 98 and 100 of the base 84. The groove 90 of each cover 22 and 24 communicates with a transverse notch 102, the groove 92 communicating with a transverse notch 104, the groove 94 communicating with a transverse notch 106 and the groove 96 communicating with a transverse notch 108. The notches 102 and 104 are each dimensioned to receive the end portions of the arms 66 of a respective terminal 18, the notches 106 and 108 being dimensioned to received the end portions of the arms 66' of a respective terminal 20. The notches 102, 104, 106 and 108 are constantly spaced from each other and are arranged in a row extending diagonally across the base 84, the spacing between these notches being the same as that between the cavities 56.

Each cover 22 and 24 can be mated with the housing 16 in each of two orthogonal angular orientations to provide for the use of the connector 2 according to its two different modes of use. For the first mode, each cover can be mated with the housing 16, guided by the posts 42, in a first angular orientation with the side walls 86 of the cover embracing the side walls 26 of the housing 16 and bottoming on the ribs 40 of these side walls, whereby the grooves 90, 92, 94 and 96 of the cover are aligned with the grooves 32, 34, 36 and 38, respectively, of the side walls 28, each pair of aligned grooves defining a first circular cross-section channel. For the second mode of use of the connector 2, each cover is mated with the housing 16, guided by the posts 42, in a second angular orientation with the side walls 86 of the cover embracing the side walls 28 of the housing 16 and bottoming on the ribs 40 on those side walls, whereby the grooves of the cover co-operate with those of the guide walls 26 to provide second circular cross-section channels which extend at right angles to those associated with said first mode.

The first mode of use of the connector 2 will now be described with particular reference to FIGS. 1 to 4. In order to prepare the housing 16 for use, a terminal 18 is press-fitted into each cavity **56*a* and 56*b* with the lower slotted plate 60 of the terminal leading, and a terminal 20 is similarly press-fitted into each cavity 56*c* and 56*d* with the lower slotted plate 60' of the terminal leading. In each case, after the lower slotted plate of the terminal has been passed through the portion 78 of the respective cavity, the retention tongues of the terminal are received in the portion 80 of the cavity and are slightly deformed resiliently towards each other in their own plane by engagement of the outer edges 81 of the portion 80 of the respective cavity, whereby the terminal is fixedly anchored therein with a forced fit. The slotted plates 58 and 60 of the terminal 18 in the cavity 56*a* are received in the aligned slots 52*a* on respective faces of the wall 30. The slotted plates 58 and 60 of the terminal 18 in the cavity 56*b* are received in the slots 52*b* on respective faces of the wall 30. The slotted plates 58' and 60' of the terminal 20 in the cavity 56*c* are received in the aligned slots 52*c* on respective faces of the wall 30. The slotted plates 58' and 60' of the terminal 20 in the cavity 56*d* are received in the aligned slots 52 on respective faces of the wall 30**.

The connection of the wires of the cables 8 and 10, according to said first mode will now be described. The cable 8 is placed on the housing 16 with its wires 4 and 6 in the mouths 64 of the slotted plates 58, of respective ones of the terminals 18, and its wires 12 and 14 in the mouths 64' of the slotted plates 58' of respective ones of the terminals 20. The wires 4, 6, 12 and 14 of the cable 8 extending through the grooves 32, 34, 36 and 38, respectively, of the upper parts of the two side walls 28 of the housing 16. The cover 22 is then mated in said first angular orientation with the housing 16, whereby the end portions of the arms 66 of the slotted plate 58 of the terminal 18 are received in respective ones of the notches 102 and 104 of the cover 22. The end portions of the arms 66' of the slotted plates 58' of the terminals 20 are received in respective ones of the notches 106 and 108 of the cover 22. As will be apparent from FIGS. 3 and 4 the tips of the slotted plates penetrate the insulation of the cable 8 so that the edges 69 and 69' of the slots 62 and 62', respectively, penetrate the insulation of the respective wires 4,6,12 and 14 to make firm and permanent electrical contact with the metal cores of the wires, the arms 66 and 66', respectively, being forced away from each other, that is to say outwards. The wire stuffer surfaces 97 and the surface 88 serve to stuff the wires into the slots of the terminals 18 and 20 as the said end portions of the arms 66 and 66' are received in said notches, as the cover 22 mated with the housing 16. Also, during the mating operation, the terminal guide posts 48 and 50 serve to support the slotted plates 58 and 50' of the terminals 18 and 20, respectively, as the wires are being forced into the slots of the slotted plates 58 and 58'.

The wires of the cable 10 are then electrically and permanently connected to the slotted plates 60 and 60' of the terminals 18 and 20, respectively, by mating the cover 24 with the housing 16 in its said first orientation, in the manner described above with reference to the mating of the cover 22 with the housing 16. For this operation, of course, the housing 16 is inverted after the cover 22 has been mated therewith. Accordingly to the first mode of use, described above, of the connector 2, the cables 8 and 10 extend in the same direction in superposed parallel relationship.

Alternatively, prior to mating each cover with the housing 16, the cover can be laid with its inner surface 88 uppermost and the cable placed on the cover so that its wires 4, 6, 12 and 14 are received in the grooves 90, 92, 94 and 96, respectively, of the cover, the housing 16 being inserted between the side walls 86 of the cover until they bottom against the ribs 40.

The second mode of use of the connector will now be described with particular reference to FIGS. 7 to 9. Before loading the terminals 18 and 20 into the housing 16, the slotted plates 58 and 60 of each terminal 18 and the slotted plates 58' and 60' of each terminal 20 are relatively twisted through 90° about the neck 72 or 72', as the case may be, of the terminal, as shown in FIGS. 7 to 9 so that the planes of the two slotted plates of each terminal extend at right angles to each other. The terminals 18 and 20 are then inserted into their respective cavities 56*a* to 56*d*, in the manner described with reference to said first mode of use. The domed portions 82 of the cavities 56 accommodate the twisted necks.

According to the second mode of use, the slotted plates 58 of the terminals 18 received in the respective pairs of aligned slots 54*a* and 54*b* and the slotted plates 58' of the terminals 20 are received in the respective pairs of aligned slots 54*c* and 54*d*. The shoulders 70 and 70' of the slotted plates 58 and 58' respectively, abut the surface 44 of the central wall 30 of the housing 16. The slotted plates 60 and 60' of the terminals 18 and 20, are, however, oriented with respect to the housing 16 exactly as described above with reference to the first mode of use of the connector 2. According to the second mode of use of the connector 2, the cover 22 is mated with the housing 16 in its second angular orientation with the edge 98 of the base 84 of the cover 22 facing leftwardly as seen in FIG. 7. The cover 24 is however mated with the housing 16 in the first angular orientation of the cover 24. The cable 8 is placed on the housing 16, or on the surface 88 of the cover 22, with such angular orientation that the wires 6, 8, 12 and 14 of the cable 8 are forced into the respective slots 62 and 62' of the slotted plates 58 and 58' of the terminals 18 and 20 respectively, when the cover 22 is mated with the housing. When the cover 24 has been mated with the housing 16 so as to connect the wires of the cable 10 to the slotted plates 60 and 60' of the terminals 18 and 20, the cables 8 and 10 extend in orthogonal directions, the wires of the cable 8 lying in the upper grooves of the side walls 26 and the wires of the cable 10 lying in the lower grooves of the side walls 28.

In both of said modes of use of the connector 2, the wires 4, 6, 12 and 14 of the cable 8 are electrically connected to the wires 4, 6, 8 and 10, respectively, of the cable 10.

Since, the central wall 30 of the housing 16 with its slots 52 and 54 and posts 48 and 50 is symmetrical about its central horizontal axis, as mentioned above, the terminals 18 and 20 can be inserted into their cavities in opposite axial orientations to those described above, that is to say so that the slotted plates 58 and 58' of the terminals 18 and 20, respectively, project from the surface 46 of the central wall 30 in either of the first and second modes of use. The possibility of error, when loading the terminals into the housing, is thereby reduced.

Figure 11:
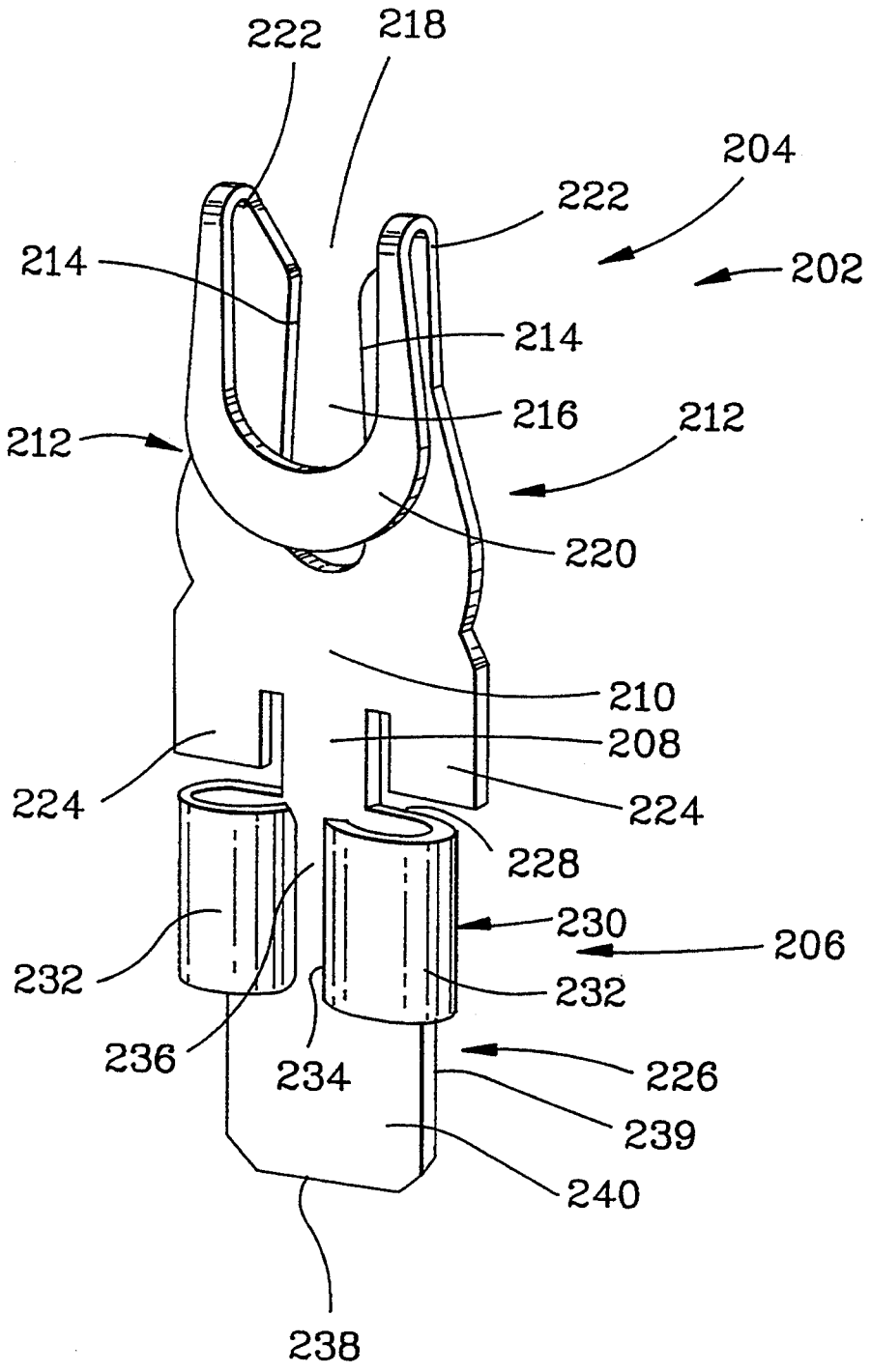
FIG. 11 is an isometric view of a hermaphroditic electrical terminal.
Figure 12:
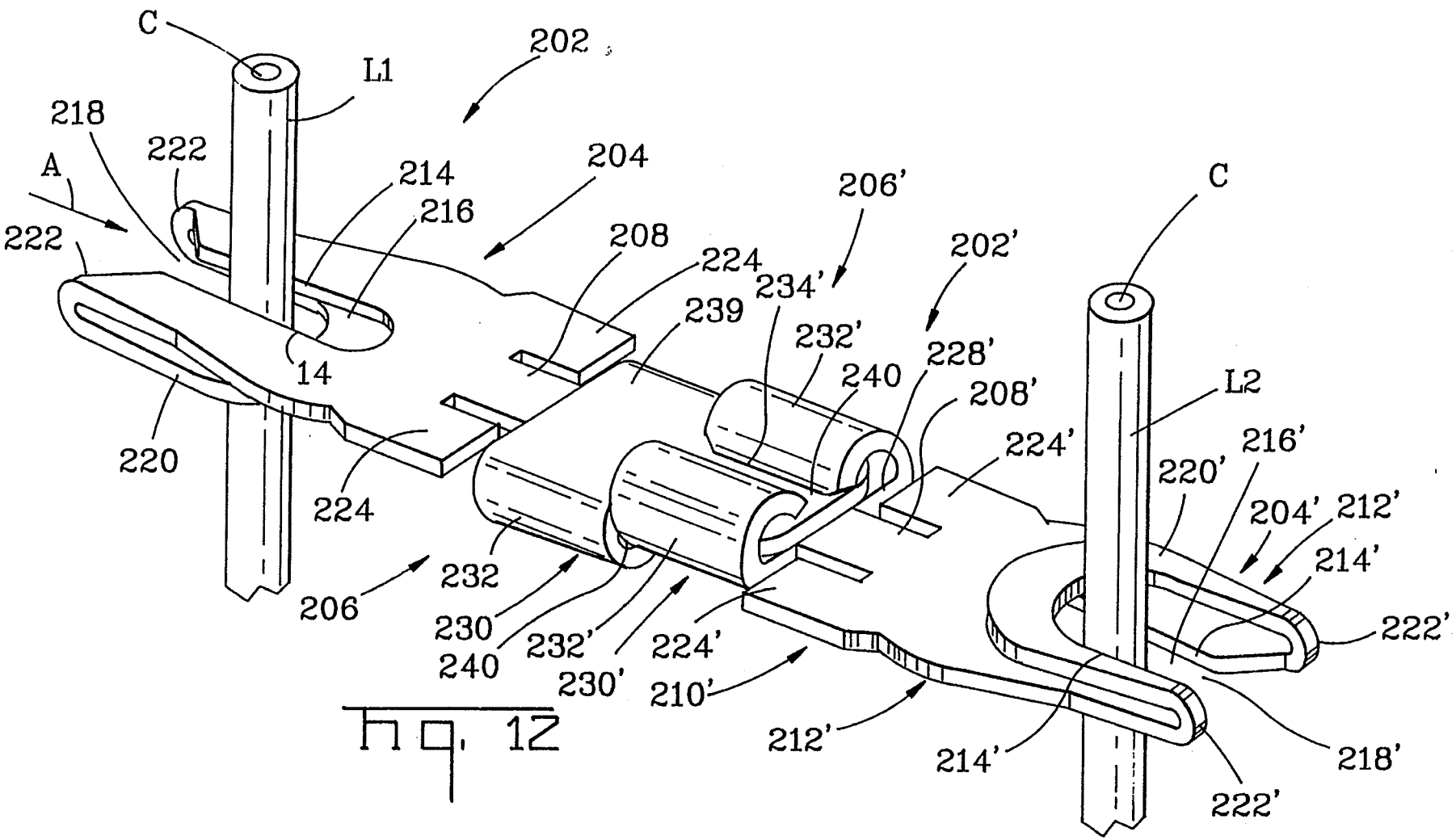
FIG. 12 is an isometric view of a pair of identical electrical terminals according to FIG. 11, when mated to connect a pair of electrical leads so that the leads extend parallel to one another.

As shown in FIG. 11, an hermaphroditic electrical terminal 202 which has been stamped and formed from a single piece of sheet metal stock, comprises a lead receiving portion 204, an hermaphroditic mating portion 206 and an elongate neck 208 connecting the portions 204 and 206. The lead connecting portion 204 comprises a flat main plate 210 from which project in a direction away from the plate 210 and the neck 218, a pair of opposed arms 212 presenting insulation displacing opposed edges 214 defining a lead receiving blind slot 216 having a flared lead guiding mouth 218 opening in a direction away from the plate 210. A U-shaped back up spring 220 is connected at its ends to respective outer tips 222 of the arms 212 and extends across the slot 216. There depend from the plate 210, a pair of rectangular retention lugs 224, one lug 224 being disposed on each side of the neck 208. The lugs 24 are coplanar with the plate 10 and with the neck 208. The mating portion 206 comprises a flat elongate plate 226, which is coplanar with the neck 208, the plate 210 and the lugs 224. One end edge 228 of the plate 226, proximate to, but spaced from, the lugs 224, is connected centrally of its length, to the neck 208. The mating portion 206 comprises a receptacle 230 having a pair of arcuate cross section, elongate spring ears 232 projecting from opposite longitudinal edges of the plate 226, overlying the plate 226 and being bowed away therefrom. Each ear 232 has a free contact edge 234 extending parallel to, and being spaced from, a first major surface 236 of the plate 226 by a distance slightly less than the thickness of the plate 226. Longitudinally, the ears 232 extend from the edge 228 of the plate 226 towards the other end edge 238 thereof, over approximately half of the length of the plate 226. The receptacle 230 thus consists of the ears 232 and that part of the plate 226 which is overlayed thereby. The plate 226 has a second major surface 239, which is plane and is devoid of projections, opposite to the major surface 236. Between its end edge 238, and the ends of the ears 232 remote from the edge 228, the plate 226 constitutes a flat tab 240 for mating with the receptacle 230' of an identical hermaphroditic terminal 202' as shown in FIG. 12, in which Figure the parts of the terminal 202' bear the same reference numerals as those used above in respect of the terminal 202, but with the addition of prime symbol.

Figure 22:
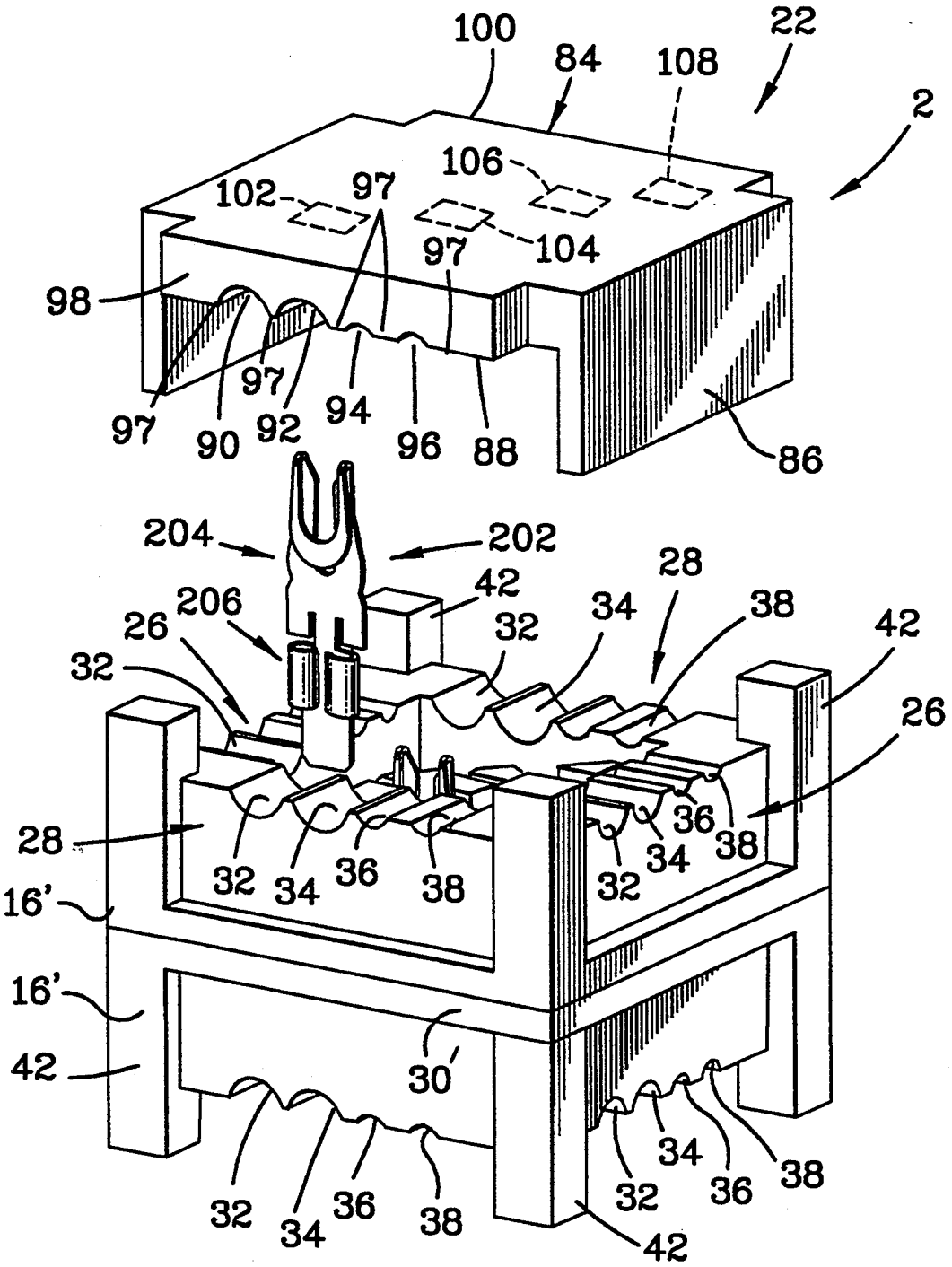
FIG. 22 is a partially exploded isometric view of an embodiment of the instant invention which utilizes the hermaphroditic electrical terminals of FIG. 11.

In practice, the terminals and 202 and 202' will be received in respective terminal receiving slots in a modified version of the above mentioned insulating housing, the retention lugs 224 and 224' of the respective terminals having been force fitted into the slots of the respective housings. For example, while not specifically shown, it should be imaginable to provide a two piece housing 16', 16' similar to housing 16 of FIG. 1, where the housing is divided across the central horizontal wall 30 at 30' as shown in FIG. 22, forming two mating faces.

The terminals would be so situated, that the terminals would be fully mated when the two faces abut.

Before mating the terminals 202 and 202', an insulated electrical lead L1 is inserted into the lead receiving slot 216 of the terminal 202 guided by the mouth 218 of the slot 216 and an insulated electrical lead L2 is inserted into the slot 216' of the terminal 202' guided by the mouth 218' of the slot 216'. Each lead is inserted into its respective slot transversely of the length of the lead. In each case, the edges of the lead receiving slot displace the insulation of the lead and thus make firm electrical connection with the core C of the lead. The connection between the slot edges and the core C is maintained by the respective back up spring 220 or 220' despite any temperature cycling to which the terminal may be later subjected when in use.

When mated, the terminals 202 and 202' lie, according to a first mode of use of the terminals, in back to back relationship with their main plates 210 in coplanar relationship. The tab 240 of the terminal 202 is received in the receptacle 230' of the terminal 202'. In each case, the free contact edges of the ears of the receptacle of one terminal, bear against the plain second major surface of the tab of the other terminal, whereby the mating portions 206 and 206' of the terminals 202 and 202' are resiliently and firmly secured in their mated relationship. Since the portions 204 and 204' of the respective terminals 202 and 202' are coplanar, the leads L1 and L2 extend parallel to each other.

As will be apparent from the above description, the lead receiving portion of each terminal receives the lead in the opposite direction to that in which the receptacle portion of the terminal receives the tab.

Figure 13:
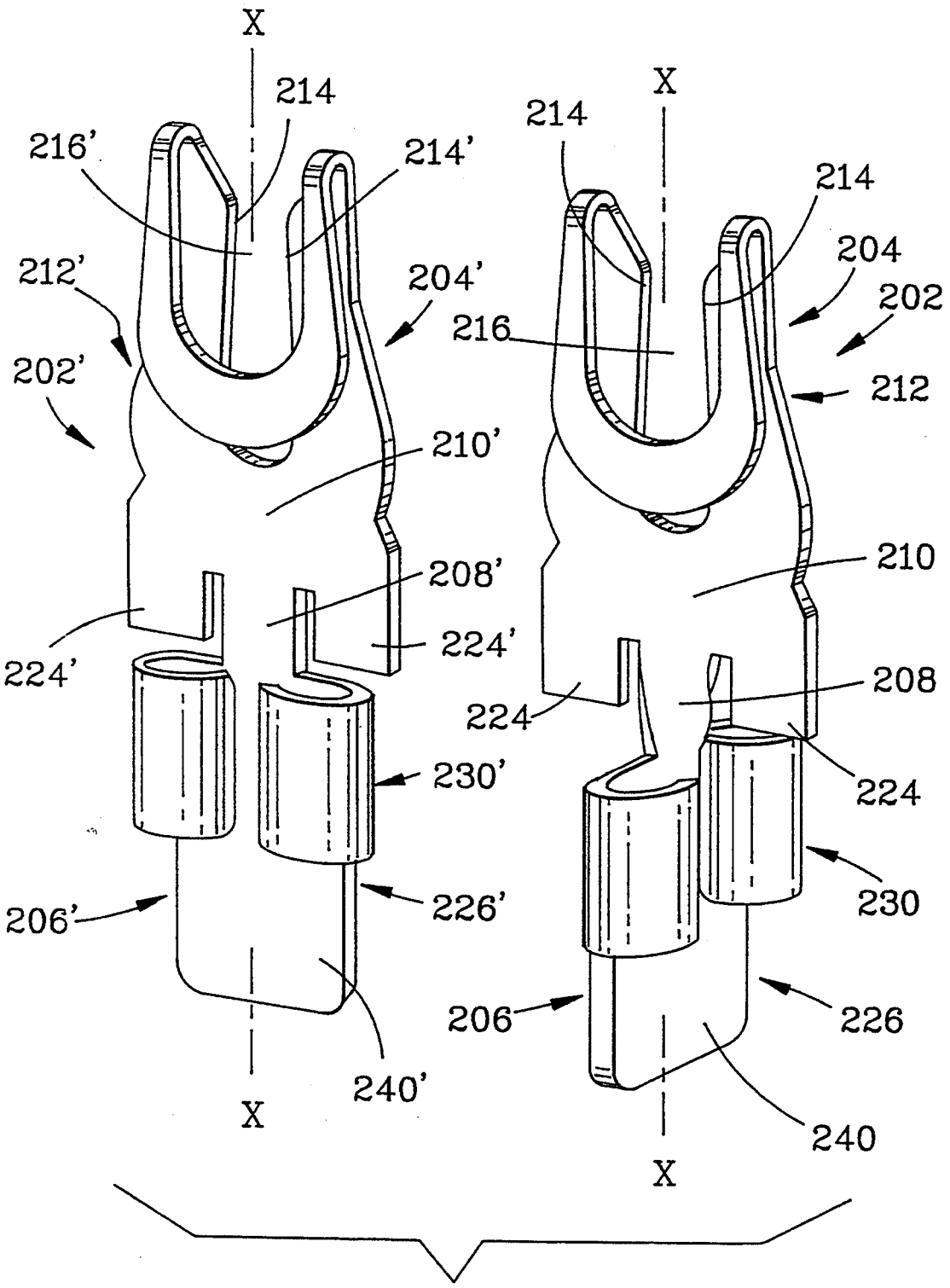
FIG. 13 is an isometric view of the pair of terminals in an unmated state, one of the terminals having been prepared for mating with the other terminal to connect a pair of leads so as to extend mutually orthogonally with respect to each other.

As mentioned above, while the leads L1 and L2 may be required to extend in parallel directions, as shown in FIG. 12, in other applications, the leads L1 and L2 may be required to extend mutually orthogonally. In this case, one of the terminals, in the present example, the terminal 202, is prepared, as shown in FIG. 13, in order to enable this second mode of use of the terminals 202 and 202'. To this end, the portions 204 and 206 of the terminal 202 are relatively twisted through 90°, about the longitudinal axis X—X of the terminal, which axis bisects the neck 208, whereby the plates 210 and 226 of the terminal 202 extend at right angles to each other. The neck 208 is accordingly torsionally, and plastically deformed as shown in FIG. 13. The plane of the plate 226 now lies midway between the edges 214 of the lead receiving slot 216.

Figure 14:
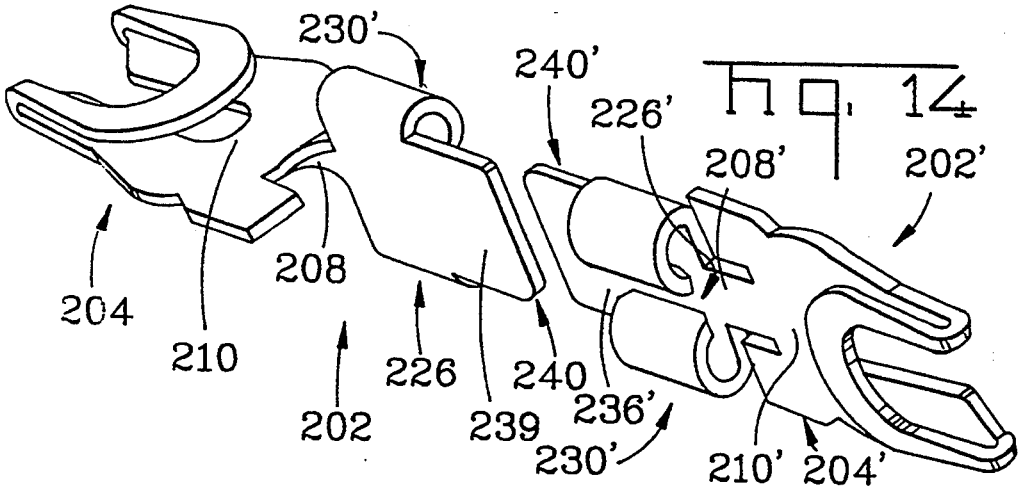
FIGS. 14 to 16 are isometric views, showing the terminals of FIG. 13 in a successive relative positions during mating thereof.
Figure 15:
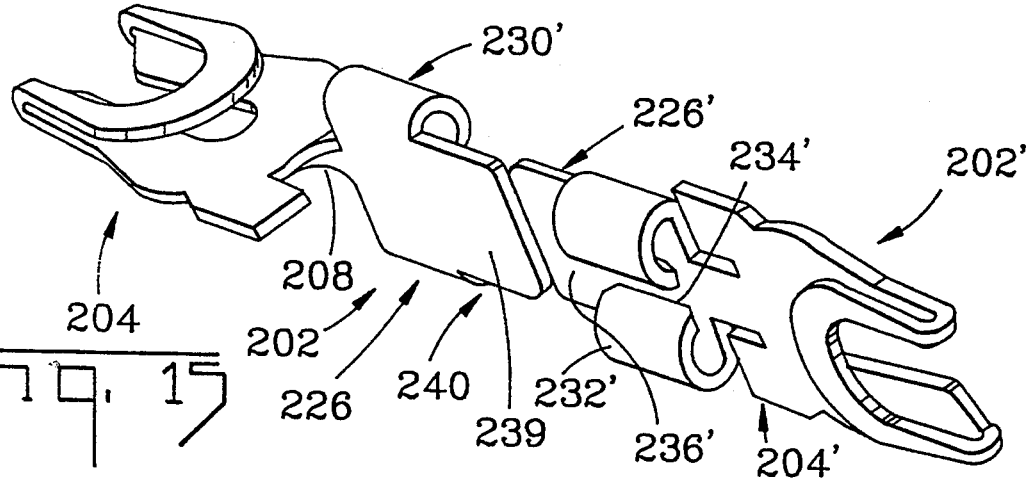
Figure 16:
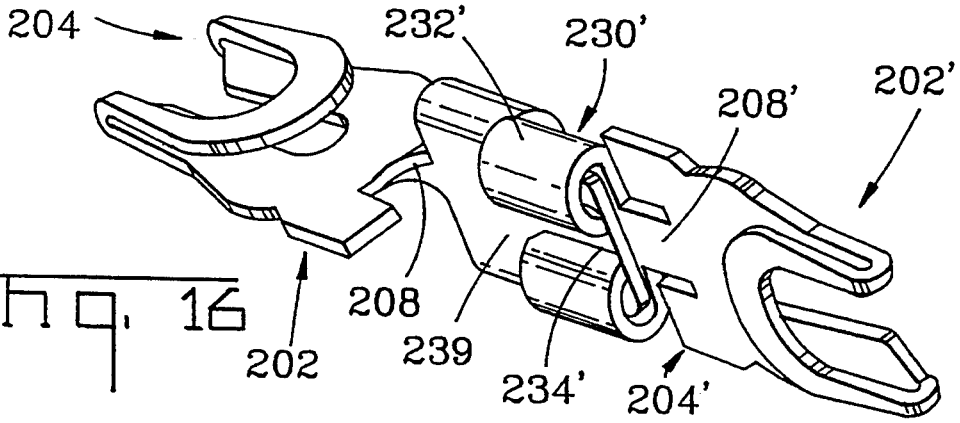

Thus, when the terminals 202 and 202' are mated as shown in FIGS. 14 to 16 so that the tab 240 of the terminal 202 is received in the receptacle 230' of the terminal 202' and the tab 240' of the terminal 202' is received in the receptacle 230 of the terminal 202, in the manner described above with reference to FIG. 12, the main plate 210 of the terminal 202 extends at right angles to the main plate 210' of the terminal 202'. As in the first mode of use, the plates 226 and 226' of the terminals 202 and 202' lie in superposed parallel relationship, with the free edges 234 of the ears 232 of the receptacle 230 engaging the major surface 239' of the plate 226' and the edges 234' of the ears 232' engaging the major surface 239 of the plate 226.

Figure 17:
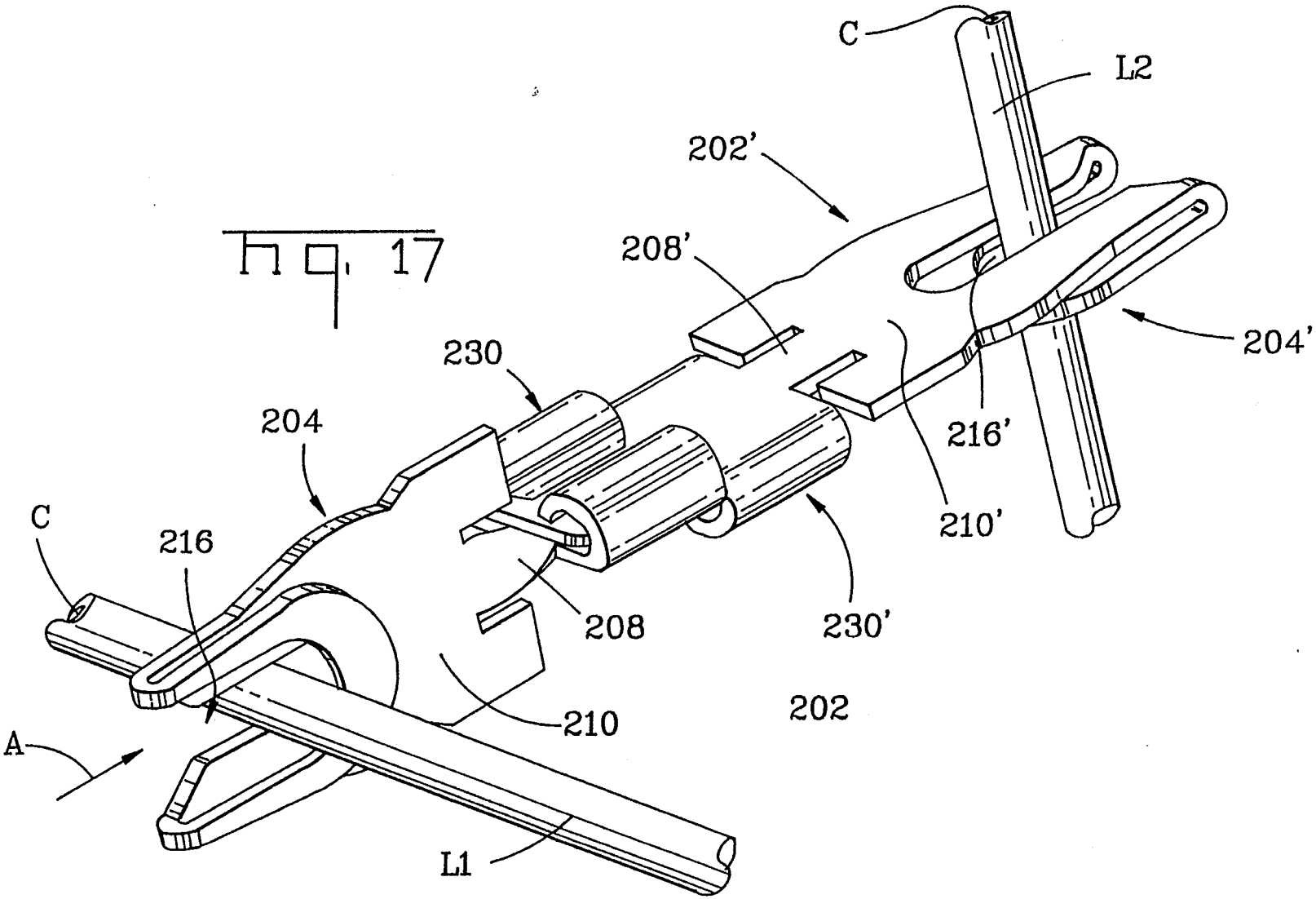
FIG. 17 is an isometric view showing the terminals of FIG. 13 mated with each other and having leads connected thereto and extending in mutually orthogonal relationship.
Figure 16:
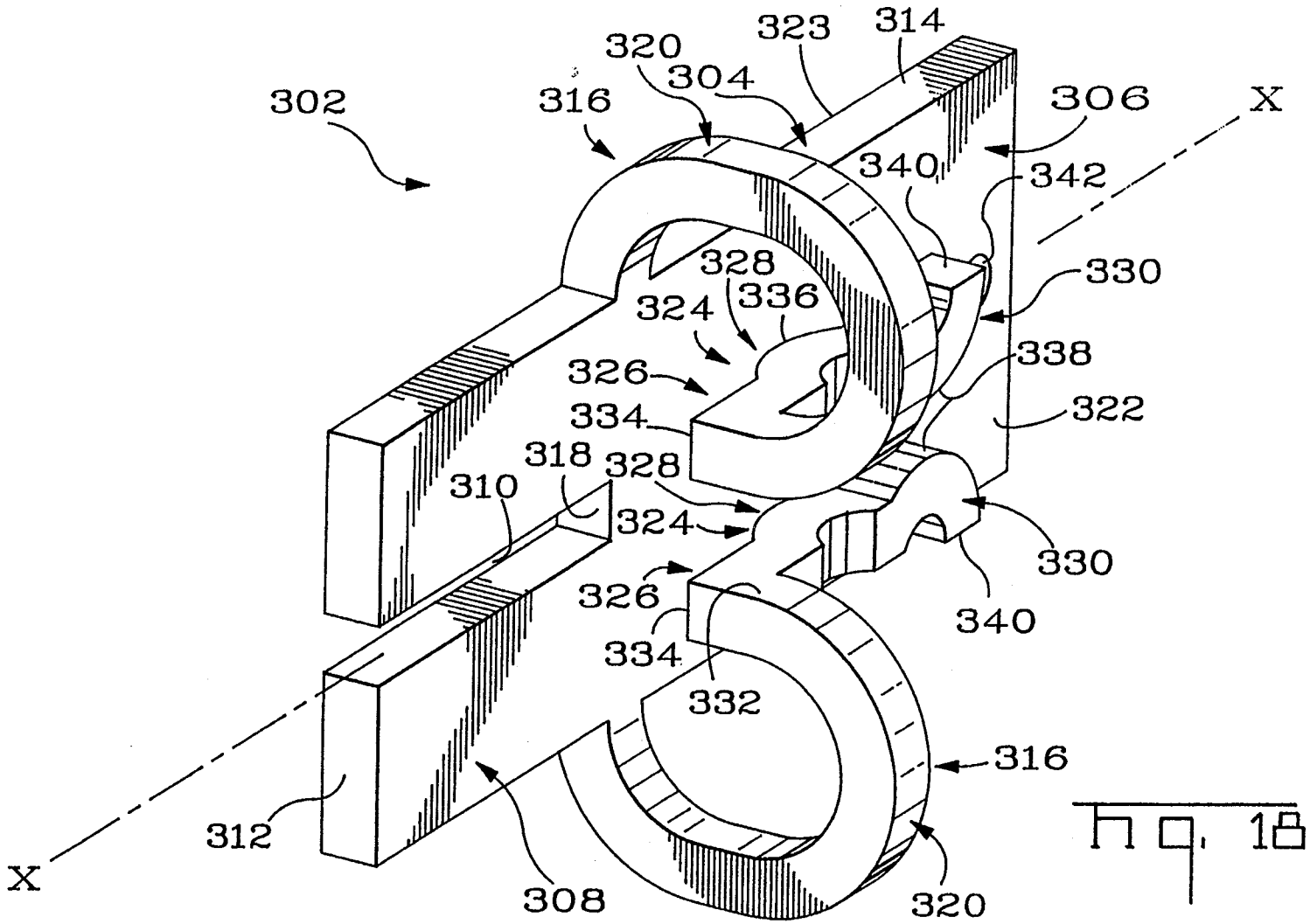

In this second mode of use, leads L1 and L2 inserted into the lead receiving slots 216 and 216' of the terminals 202 and 202', respectively, electrically to connect the cores C of the leads, will extend orthogonally with respect to each other as shown in FIG. 17, since the lead receiving portions of the terminals lie in orthogonal planes.

Although, according to usual requirements, the leads must extend either parallel to each other as shown in FIG. 12, or at right angles to each other as shown in FIG. 17, the plates 210 and 226 and/or the plates 210' and 226' may be relatively twisted about the respective necks through an angle other than a 90° angle, if such an angle is required.

A further embodiment of electrical terminal is shown in FIG. 18 as a hermaphroditic electrical terminal 302 which has been stamped and formed from a single piece of sheet metal, comprises a flat, elongate, rectangular contact plate 304 having a rear wire connecting portion 306 and a forward mating tab portion 308 having a central longitudinal axis X—X. A rectangular, elongate blind slot 310, bisected by the axis X—X, opens into the forward edge 312 of the mating portion 308. The width of the slot 310, the longitudinal edges which are parallel to one another, very slightly exceeds the thickness of the metal stock from which the terminal 302 was formed. There projects from each of two opposite longitudinal edges 314 of the contact plate 304 a contact spring, which is generally referenced 316, at a position slightly rearwardly of the base 318 of the slot 310. Each contact spring 316 comprises a rectangular cross-section arcuate part 320 extending from a respective edge 314 and being curled over a first major surface 322 of the contact plate 304. The plate 304 has a further major surface 323 opposite to the major surface 322. Each arcuate part 320, which is disposed in a plane that is perpendicular to that of the plate 304, terminates at its end remote from the edge 314 and proximate to the major surface 322, in a cantilever spring beam part 324 extending rearwardly from the contact spring part 320 alongside the major surface 322 of the contact plate 304.

Figure 20:
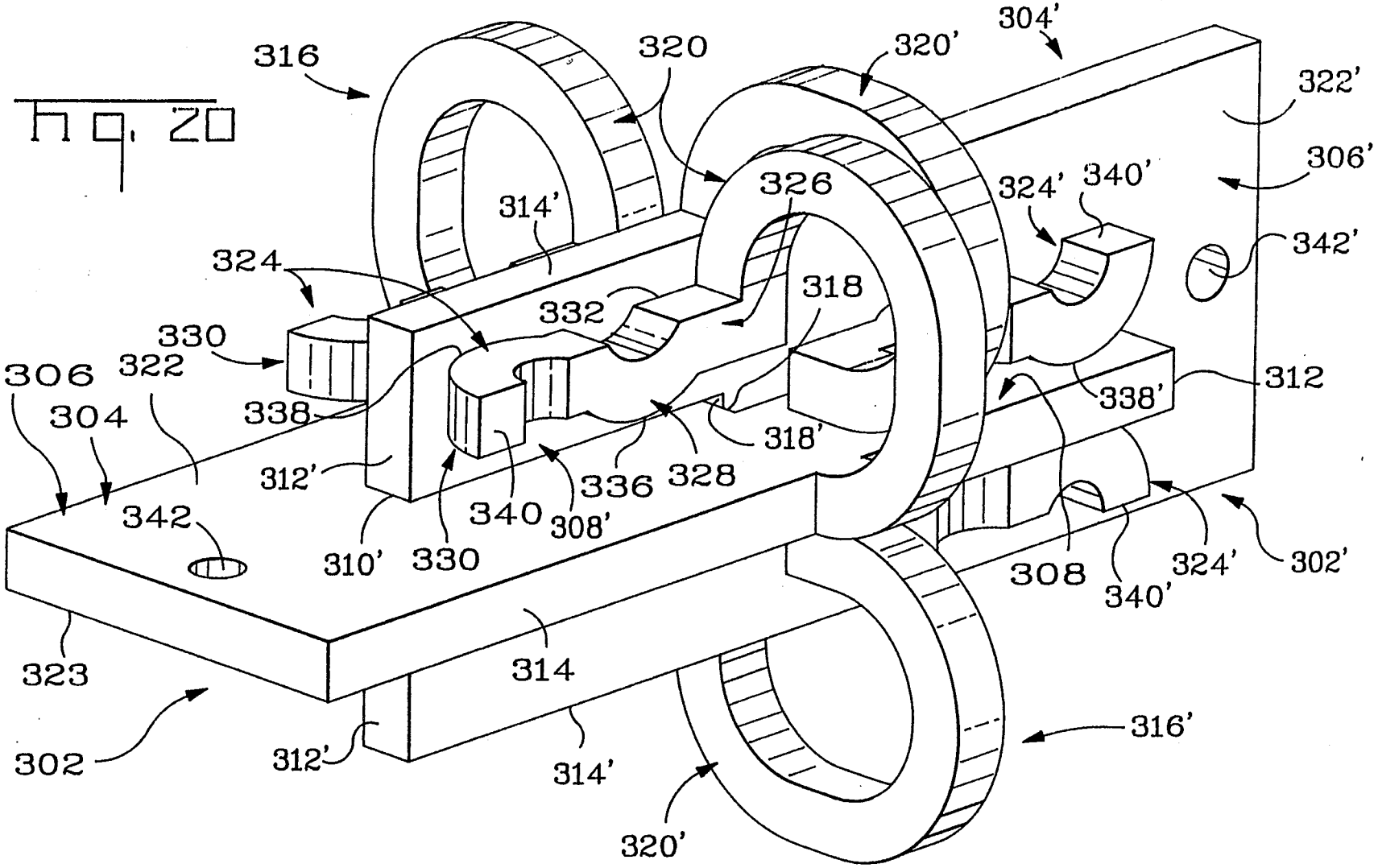
FIG. 20 is an isometric view showing the terminals when mated according to a second mated mode.

Each spring beam part 324 has a rectilinear cross-section forward portion 326 connected to, and projecting rearwardly from the respective arcuate spring part 320 normally of the plane thereof. Each spring beam part 324 has an intermediate joggle 328 extending rearwardly from the part 326, and a rear end joggle 330 extending rearwardly from the joggle 328, as best seen in FIG. 20. The forward portion 326 of each spring part 324 has an inwardly facing, flat, first tab portion guide surface 332, the surfaces 332 of the portions 326 of the two spring beam parts 324 facing each other and extending normally of the major surface 322 of the contact plate 304. Each portion 326 has a second, flat, tab portion guide surface 334 which is disposed orthogonally with respect to the guide surface 332 and faces the major surface 332 of the contact plate 304, the guide surface 332 extending parallel to the surface 322. Each intermediate joggle 328 is bowed towards the major surface 322 of the contact plate 304 so as to present a smoothly convex, arcuate, contact surface 336 projecting towards the major surface 322 of the plate 304, as best seen in FIG. 20. The end joggle 330 of each spring beam part 324 is bowed in a direction which is orthogonal to that in which the joggle 328 is bowed, so as to present a smoothly arcuate, forwardly directed, convex contact surface 338, the surfaces 338 facing, and being aligned with, each other. Each joggle 330 has a free end face end 340.

Figure 19:
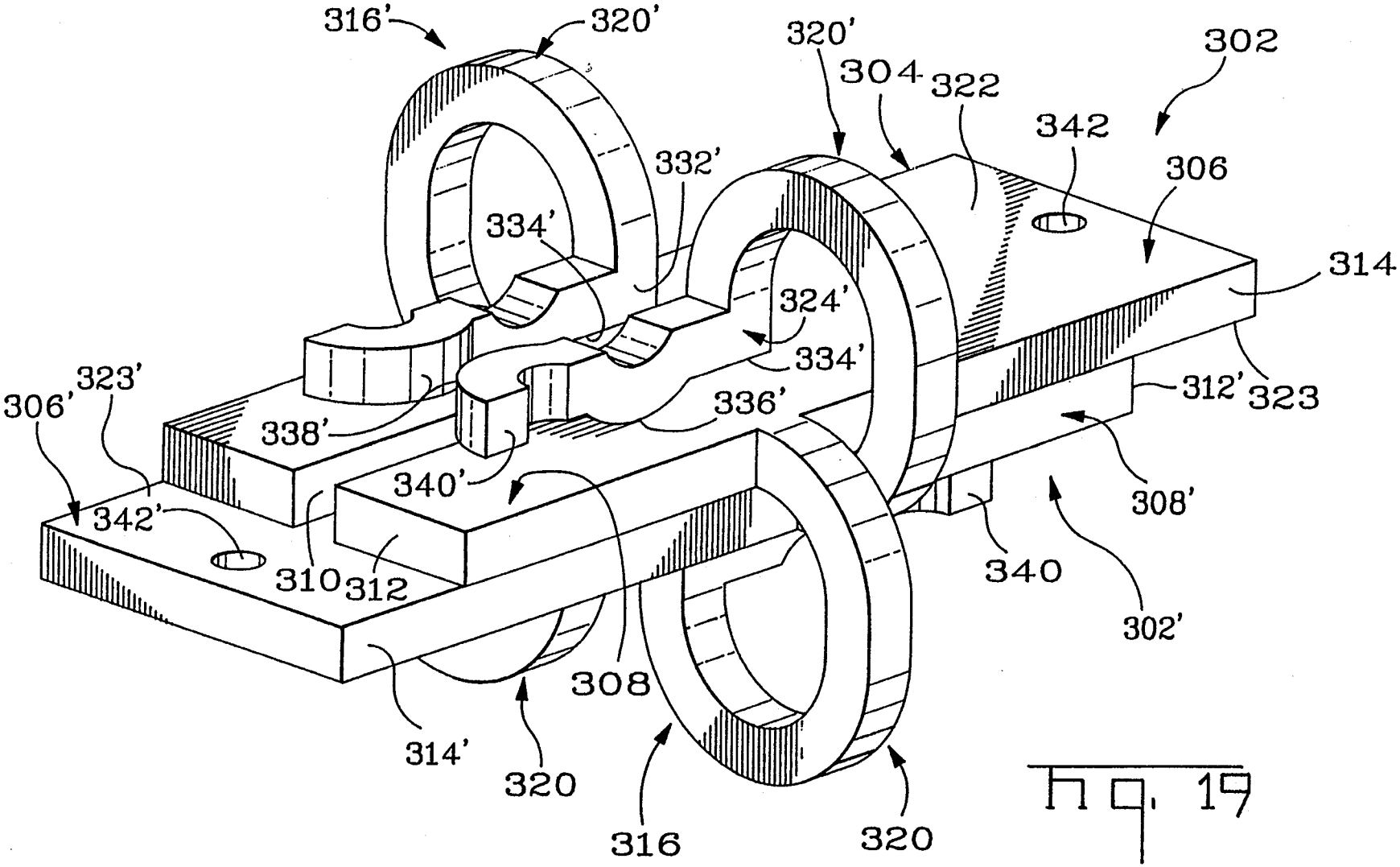
FIG. 19 is an isometric view of a pair of identical terminals according to FIG. 18 when mated in a first mating mode.

As shown in FIG. 19, the terminal 302 can be mated in coplanar relationship, according to a first mating mode, with an identical terminal 302' the parts of which bear the same reference numerals as those used above but with the addition of a prime symbol. In order to mate the terminals 302 and 302' according to said first mode they are located with their respective tab portions 308 and 308' facing each other and are advanced relatively towards each into mating relationship, with a major surface 323 and 323' respectively, in sliding face to face engagement with each other, the contact springs 316 and 316' of the terminals 302 and 302' respectively, therefore extending in opposite directions. As the terminals 302 and 302' are so advanced towards each other the forward edge 312 of one terminal, guided by the surfaces 334 or 334' as the case may be, of the other terminal engages under the surfaces 336 or 336', as the case may be, of the other terminal and advances thereunder until the contact spring arcuate parts 320 and 320', of the two terminals 302 and 302', engage each other as shown in FIG. 19 and thereby act as stops determining the final mated, axial positions of the terminals 302 and 302'. In the mated condition of the terminals 302 and 302' the contact surfaces 336 of the terminal 302 engage the major surfaces 322' of the contact plate 304' of the terminal 302', and vice versa. Thus, in the mated condition of the terminals 302 and 302', the tab portion of one terminal is gripped resiliently between the contact surfaces 336 and 336', as the case may be, of the spring beam parts of the other terminal. The terminals 302 and 302' are accordingly securely electrically connected to each other when mated in said first mating mode. During the mating of the terminals 302 and 302', the spring beam parts 324 and 324' are deflected resiliently away from the tab portions 308 and 308' respectively, so that the respective arcuate spring parts 320 and 320', respectively, are resiliently deformed whereby the parts 320 and 320' act as backup springs for the spring beam parts 324 and 324'. The contact surfaces 336 and 336' are accordingly pressed against the respective tab portions 308' and 308 and the major surfaces 323 and 323', of the contact plates 304 and 304' are pressed together by virtue of the leaf spring actions of the spring beam parts 324 and 324', backed up by the actions of the arcuate parts 320 and 320' of the contact springs 316 and 316', respectively.

As shown in FIG. 20, the terminals 302 and 302' can be mated according to the second mating mode with their contact plates 304 and 304' in perpendicular relationship with each other. In order to mate the terminals 302 and 302' according to this mode, the terminals are located with their bases 304 and 304' in orthogonal relationship with the end edges 312 and 312' of the terminals 302 and 302' respectively, facing each other and the slots 310 and 310' of the terminals being aligned with each other. The terminals 302 and 302' are then mated by advancing them towards each other until the tab portions 308 and 308' are received in the slots 310' and 310, respectively, with the bases 318 and 318', of the slots 310 and 310', respectively, bottomed against each other. In the mated condition of the terminals 302 and 302' the tab portion 308' on one side of the slot 310' of the terminal 302' is received between the contact surfaces 338 of the spring beam part 324 of the terminal 302, the tab portion 308 on one side of the slot 310 of the terminal 302 being received between the contact surfaces 338' of the contact springs 316' of the terminal 302'. During the mating of the terminals 302 and 302', the forward edges 312 and 312' of the contact plates 304 and 304', respectively, guided by the surfaces 332' and 332 respectively, ride over the contact surfaces 338' and 338 respectively, of the spring beam parts 324' and 324 respectively. The spring beam parts 324 and 324' of the contact springs 316 and 316', respectively, are accordingly resiliently deflected outwardly, in the manner of leaf springs and the arcuate contact spring parts 320 and 320' are resiliently deformed so as to act as back up springs, whereby the contact surfaces 338 and 338' are firmly pressed against the tab portions 308' and 308, respectively. Terminals 302 and 302' are accordingly firmly electrically connected to each other.

The provision of two contact springs on each of the terminals ensures contact redundancy and continuous electrical connection between the terminals when used in a vibratory environment, for example in a motor vehicle.

Figure 21:
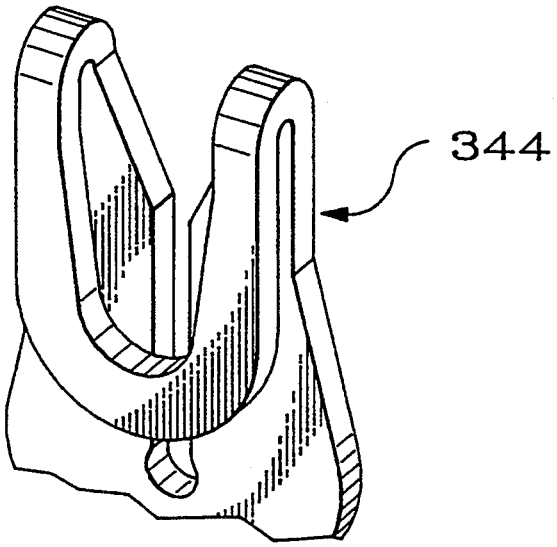
FIG. 21 is a fragmentary isometric view illustrating a modification of the terminals.

The connecting portions 306 and 306' of the terminals 302 and 302' may be planar as shown in the drawings being a bus bars fixed to respective electrical connector mating housings, having holes 342 and 342' respectively, therethrough for receiving fasteners for connecting leads to the portions 306 and 306', or for receiving leads to be soldered thereto. Alternatively, the connecting portions of the terminals may be formed as contact elements, for example, slotted plate insulation displacement contact elements 344 as shown in FIG. 21, for electrical connection to leads. The terminals 302 and 302' may be included in mating, multiple contact electrical connectors each comprising a multiplicity of these terminals. In such case, the terminals 302 and 302' of the respective connectors, will be relatively oriented to mate according to the mode of FIG. 19, where the leads of the connectors are to extend in the same direction, but according to the mode shown in FIG. 20, when the leads of one connector are to extend orthogonally with respect to those of the other connector.

We claim:

1. An electrical connector housing assembly comprising an insulating housing and first and second insulating covers for mating with the housing, the housing having a plurality of through cavities each for accommodating an electrical terminal with wire receiving portions thereof projecting from opposite surfaces of the housing, each cover having a corresponding plurality of notches each for receiving the wire receiving portion of the respective terminal and being bounded by wire stuffer surfaces for stuffing wires into said wire receiving portions, each cover being matable with the housing to stuff wires into the wire receiving portions on a respective one of said opposite surfaces of the housing when the terminals are accommodated in said cavities; characterized in that at least one of the covers is matable with the housing in a first angular orientation with respect thereto to stuff wires extending in a first direction, into said wire receiving portions on said respective surface of the housing, and in a second angular orientation with respect to the housing to stuff wires extending in a second direction, into said wire receiving portions on said respective surface of the housing, the notches of said at least one cover being so distributed thereon as to be aligned with respective ones of said cavities in each of said angular orientations of said at least one cover, said first and second angular orientations being non-parallel.

2. An assembly as claimed in claim 1, characterized in that said first and second angular orientations of said at least one cover are orthogonal with respect to each other.

3. An assembly as claimed in claim 1, characterized in that the housing has a first pair of opposed side walls and a second pair of opposed side walls extending at right angles to the side walls of the first pair, said at least one cover having a pair of opposed side walls for mating engagement either with the first side walls or the second side walls.

4. An assembly as claimed in claim 3, characterized in that the housing side walls are connected by a central wall presenting said opposite surfaces of the housing.

5. An assembly as claimed in claim 4, characterized in that said central wall is square, a cover guide post being provided at each corner of the central wall for guiding the cover side walls, stop ribs for the cover side walls extending between the cover guide posts.

6. An assembly as claimed in claim 1, characterized by guide members for said wire receiving portions provided on each of said opposite surfaces of the housing, said guide members defining intersecting first and second pairs of aligned slots, for accommodating said wire receiving portions, the slots of said first pairs extending at right angles to the slots of the second pairs, each terminal receiving cavity being located at the intersection between a respect first and second pair of said slots.

7. An assembly as claimed in claim 6, characterized in that said guide members are in the form of first and second posts projecting from said opposite surfaces of the housing, the first posts being of substantially triangular cross section and the second posts being of substantially square cross section, a pair of opposite first posts and a pair of opposite second posts cooperating to define a respective first and second pair of said aligned pairs of slots.

8. An assembly as claimed in claim 7, characterized in that said guide members on one side of said opposite surfaces are arranged symmetrically with respect to the guide members on the other of said opposite surfaces.

9. An assembly as claimed in claim 8, characterized in that said guide members are arranged in groups extending diagonally across said opposite surfaces, at least one guide member being common to two adjacent groups of said guide members.

10. An assembly as claimed in claim 1, characterized in that the terminal receiving cavities are arranged in a row extending diagonally across the housing in constantly spaced relationship, said notches being arranged in a row extending diagonally across said at least one cover in the same constantly spaced relationship as said cavities.

11. An assembly as claimed in claim 1, and including said terminals, characterized in that the wire receiving portions of each terminal are planar and are connected by way of a neck about which the wire receiving portions can be twisted at least to an extent to bring the planes of the wire receiving portions into orthongonal relative relationship.

12. The connector of claim 1, wherein said housing includes a split through a central wall thereof thereby forming the insulating housing into halves.

13. The connector of claim 12, wherein each housing half has at least one of said electrical terminals therein, said electrical terminals being interconnectable for electrical interconnection of said wires.

* * * * *